US006820964B2

(12) United States Patent
Delametter et al.

(10) Patent No.: US 6,820,964 B2
(45) Date of Patent: Nov. 23, 2004

(54) TAPERED THERMAL ACTUATOR

(75) Inventors: Christopher N. Delametter, Rochester, NY (US); David P. Trauernicht, Rochester, NY (US); John A. Lebens, Rush, NY (US); Edward P. Furlani, Lancaster, NY (US); Stephen F. Pond, Oakton, VA (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/293,077

(22) Filed: Nov. 13, 2002

(65) Prior Publication Data

US 2004/0036741 A1 Feb. 26, 2004

Related U.S. Application Data

(63) Continuation-in-part of application No. 10/227,079, filed on Aug. 23, 2002.

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS

| | | | |
|---|---|---|---|
| 3,747,120 A | 7/1973 | Stemme | |
| 3,946,398 A | 3/1976 | Kyser et al. | |
| 4,296,421 A | 10/1981 | Hara et al. | |
| 5,599,695 A | 2/1997 | Pease et al. | |
| 5,771,882 A | 6/1998 | Psaros et al. | |
| 5,902,648 A | 5/1999 | Naka et al. | |
| 6,067,797 A | 5/2000 | Silverbrook | |
| 6,087,638 A | 7/2000 | Silverbrook | |
| 6,180,427 B1 | 1/2001 | Silverbrook | |
| 6,239,821 B1 | 5/2001 | Silverbrook | |
| 6,243,113 B1 | 6/2001 | Silverbrook | |
| 6,254,793 B1 | 7/2001 | Silverbrook | |
| 6,274,056 B1 | 8/2001 | Silverbrook | |
| 6,631,979 B2 * | 10/2003 | Lebens et al. | 347/54 |

FOREIGN PATENT DOCUMENTS

| | | |
|---|---|---|
| JP | 20330543 | 1/1990 |

* cited by examiner

*Primary Examiner*—Raquel Yvette Gordon
(74) *Attorney, Agent, or Firm*—William R. Zimmerli

(57) ABSTRACT

An apparatus for a thermal actuator for a micromechanical device, especially a liquid drop emitter such as an ink jet printhead, is disclosed. The disclosed thermal actuator comprises a base element and a cantilevered element including a thermo-mechanical bending portion extending from the base element and a free end portion residing in a first position. The thermo-mechanical bending portion has a base end width, $w_b$, adjacent the base element and a free end width, $w_f$, adjacent the free end portion wherein the base end width is substantially greater than the free end width. The thermal actuator further comprises apparatus adapted to apply a heat pulse directly to the thermo-mechanical bending portion causing the deflection of the free end portion of the cantilevered element to a second position. The width of the thermo-mechanical bending portion may reduce substantially quadratically or in an inverse power fashion as a function of the distance away from the base element or in at least one step reduction. The apparatus adapted to apply a heat pulse may comprise a thin film resistor. Alternatively, the thermo-mechanical bending portion may comprise a layer of electrically resistive material having a heater resistor formed therein to which is applied an electrical pulse to cause rapid deflection of the free end portion and ejection of a liquid drop.

26 Claims, 24 Drawing Sheets

TAPERED THERMAL ACTUATOR

CROSS REFERENCE TO RELATED APPLICATION

This is a continuation-in-part of commonly assigned U.S. application Ser. No. 10/227,079, entitled "Tapered Thermal Actuator," filed Aug. 23, 2002.

FIELD OF THE INVENTION

The present invention relates generally to micro-electromechanical devices and, more particularly, to micro-electromechanical thermal actuators such as the type used in ink jet devices and other liquid drop emitters.

BACKGROUND OF THE INVENTION

Micro-electro mechanical systems (MEMS) are a relatively recent development. Such MEMS are being used as alternatives to conventional electro-mechanical devices as actuators, valves, and positioners. Micro-electromechanical devices are potentially low cost, due to use of microelectronic fabrication techniques. Novel applications are also being discovered due to the small size scale of MEMS devices.

Many potential applications of MEMS technology utilize thermal actuation to provide the motion needed in such devices. For example, many actuators, valves and positioners use thermal actuators for movement. In some applications the movement required is pulsed. For example, rapid displacement from a first position to a second, followed by restoration of the actuator to the first position, might be used to generate pressure pulses in a fluid or to advance a mechanism one unit of distance or rotation per actuation pulse. Drop-on-demand liquid drop emitters use discrete pressure pulses to eject discrete amounts of liquid from a nozzle.

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electroresistive heaters to generate vapor bubbles which cause drop emission, as is discussed by Hara et al., in U.S. Pat. No. 4,296,421.

Electroresistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices. Piezoelectrically actuated devices do not impose such severe limitations on the liquids that can be jetted because the liquid is mechanically pressurized.

The availability, cost, and technical performance improvements that have been realized by ink jet device suppliers have also engendered interest in the devices for other applications requiring micro-metering of liquids. These new applications include dispensing specialized chemicals for micro-analytic chemistry as disclosed by Pease et al., in U.S. Pat. No. 5,599,695; dispensing coating materials for electronic device manufacturing as disclosed by Naka et al., in U.S. Pat. No. 5,902,648; and for dispensing microdrops for medical inhalation therapy as disclosed by Psaros et al., in U.S. Pat. No. 5,771,882. Devices and methods capable of emitting, on demand, micron-sized drops of a broad range of liquids are needed for highest quality image printing, but also for emerging applications where liquid dispensing requires mono-dispersion of ultra small drops, accurate placement and timing, and minute increments.

A low cost approach to micro drop emission is needed which can be used with a broad range of liquid formulations. Apparatus and methods are needed which combine the advantages of microelectronic fabrication used for thermal ink jet with the liquid composition latitude available to piezo-electromechanical devices.

A DOD ink jet device which uses a thermo-mechanical actuator was disclosed by T. Kitahara in JP 2,030,543, filed Jul. 21, 1988. The actuator is configured as a bi-layer cantilever moveable within an ink jet chamber. The beam is heated by a resistor causing it to bend due to a mismatch in thermal expansion of the layers. The free end of the beam moves to pressurize the ink at the nozzle causing drop emission. Recently, disclosures of a similar thermo-mechanical DOD ink jet configuration have been made by K. Silverbrook in U.S. Pat. Nos. 6,067,797; 6,087,638; 6,239,821 and 6,243,113. Methods of manufacturing thermo-mechanical ink jet devices using microelectronic processes have been disclosed by K. Silverbrook in U.S. Pat. Nos. 6,180,427; 6,254,793 and 6,274,056.

Thermo-mechanically actuated drop emitters employing a cantilevered element are promising as low cost devices which can be mass produced using microelectronic materials and equipment and which allow operation with liquids that would be unreliable in a thermal ink jet device. However, the design and operation of cantilever style thermal actuators and drop emitters requires careful attention to energy efficiency so as to manage peak temperature excursions and maximize actuation repetition frequencies. Designs which produce a comparable amount of deflection and a deflection force while requiring less input energy than previous configurations are needed to enhance the commercial potential of various thermally actuated devices, especially ink jet printheads.

Configurations for cantilevered element thermal actuators, optimized for input energy efficiency, are needed which can be operated at high repetition frequencies and with maximum force of actuation.

SUMMARY OF THE INVENTION

It is therefore an object of the present invention to provide a thermo-mechanical actuator which operates with improved energy efficiency.

It is also an object of the present invention to provide a liquid drop emitter which operates with improved energy efficiency.

The foregoing and numerous other features, objects and advantages of the present invention will become readily apparent upon a review of the detailed description, claims and drawings set forth herein. These features, objects and advantages are accomplished by constructing a thermal actuator for a micro-electromechanical device comprising a base element and a cantilevered element which includes a thermo-mechanical bending portion extending from the base element and a free end portion residing in a first position. The thermo-mechanical bending portion has a base end width, $w_b$, adjacent the base element and a free end width, $w_f$, adjacent the free end portion wherein the base end width is substantially greater than the free end width. The thermal actuator further comprises apparatus adapted to apply a heat pulse directly to the thermo-mechanical bending portion causing the deflection of the free end portion of the cantilevered element to a second position. The width of the thermo-mechanical bending portion may reduce as a function of the distance away from the base element in a functional form that results in a normalized deflection of the free end $\bar{y}(1)<1.0$. The apparatus adapted to apply a heat pulse may comprise a thin film resistor. Alternatively, the thermo-mechanical bending portion may comprise a first layer of an electrically resistive material having a heater resistor formed therein to which is applied an electrical pulse thereby causing rapid deflection of the free end portion.

The present invention is particularly useful as a thermal actuator for liquid drop emitters used as printheads for DOD ink jet printing. In this preferred embodiment the thermal actuator resides in a liquid-filled chamber that includes a nozzle for ejecting liquid. The thermal actuator includes a cantilevered element extending from a wall of the chamber and a free end residing in a first position proximate to the nozzle. Application of a heat pulse to the cantilevered element causes deflection of the free end forcing liquid from the nozzle.

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides apparatus for a thermal actuator and a drop-on-demand liquid emission device. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide drop emitters based on thermo-mechanical actuators which are configured and operated so as to avoid locations of excessive temperature, hot spots, which might otherwise cause erratic performance and early device failure.

Figure 1:
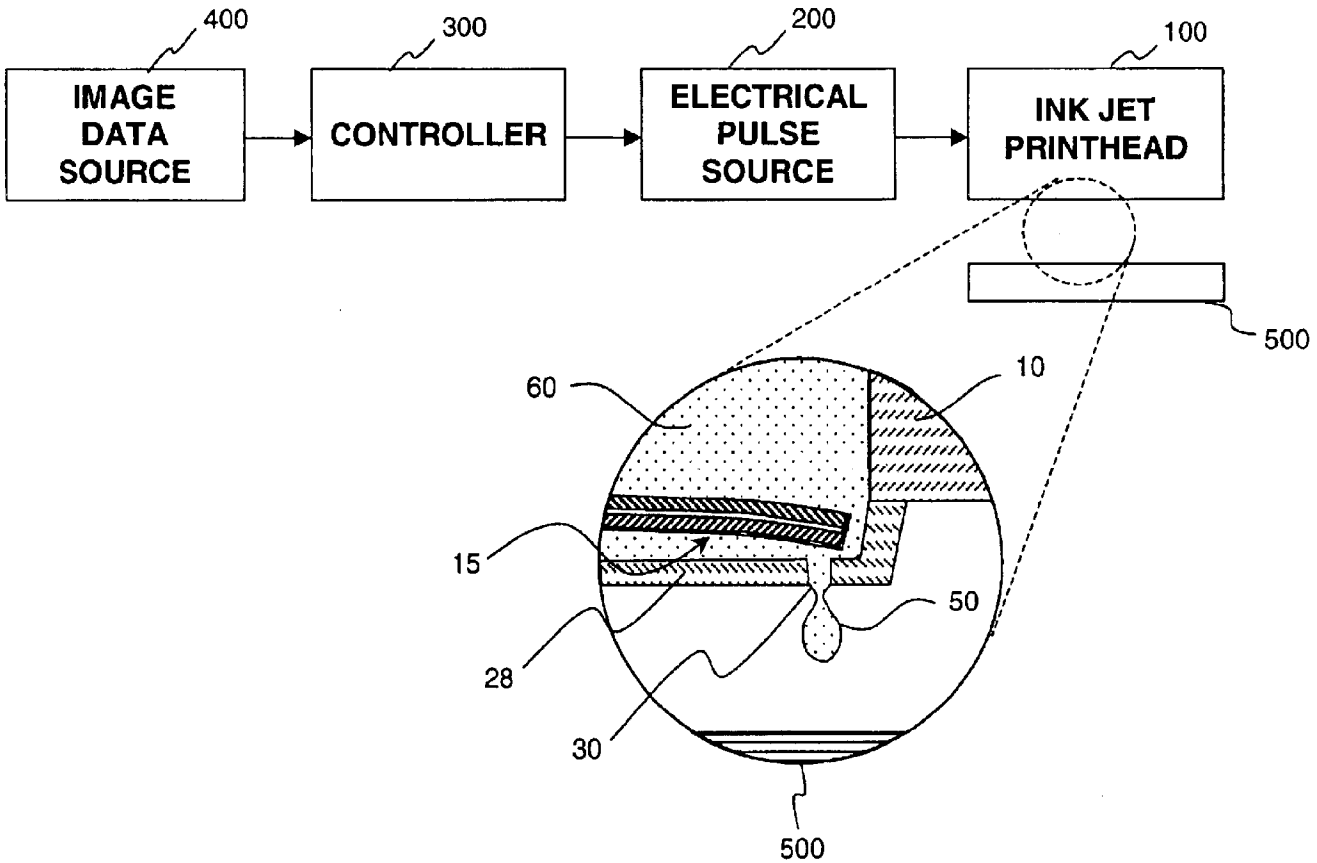
FIG. 1 is a schematic illustration of an ink jet system according to the present invention.

Turning first to FIG. 1, there is shown a schematic representation of an ink jet printing system which may use an apparatus and be operated according to the present invention. The system includes an image data source 400 which provides signals that are received by controller 300 as commands to print drops. Controller 300 outputs signals to a source of electrical pulses 200. Pulse source 200, in turn, generates an electrical voltage signal composed of electrical energy pulses which are applied to electrically resistive means associated with each thermo-mechanical actuator 15 within ink jet printhead 100. The electrical energy pulses cause a thermo-mechanical actuator 15 (herein after "thermal actuator") to rapidly bend, pressurizing ink 60 located at nozzle 30, and emitting an ink drop 50 which lands on receiver 500.

Figure 2:
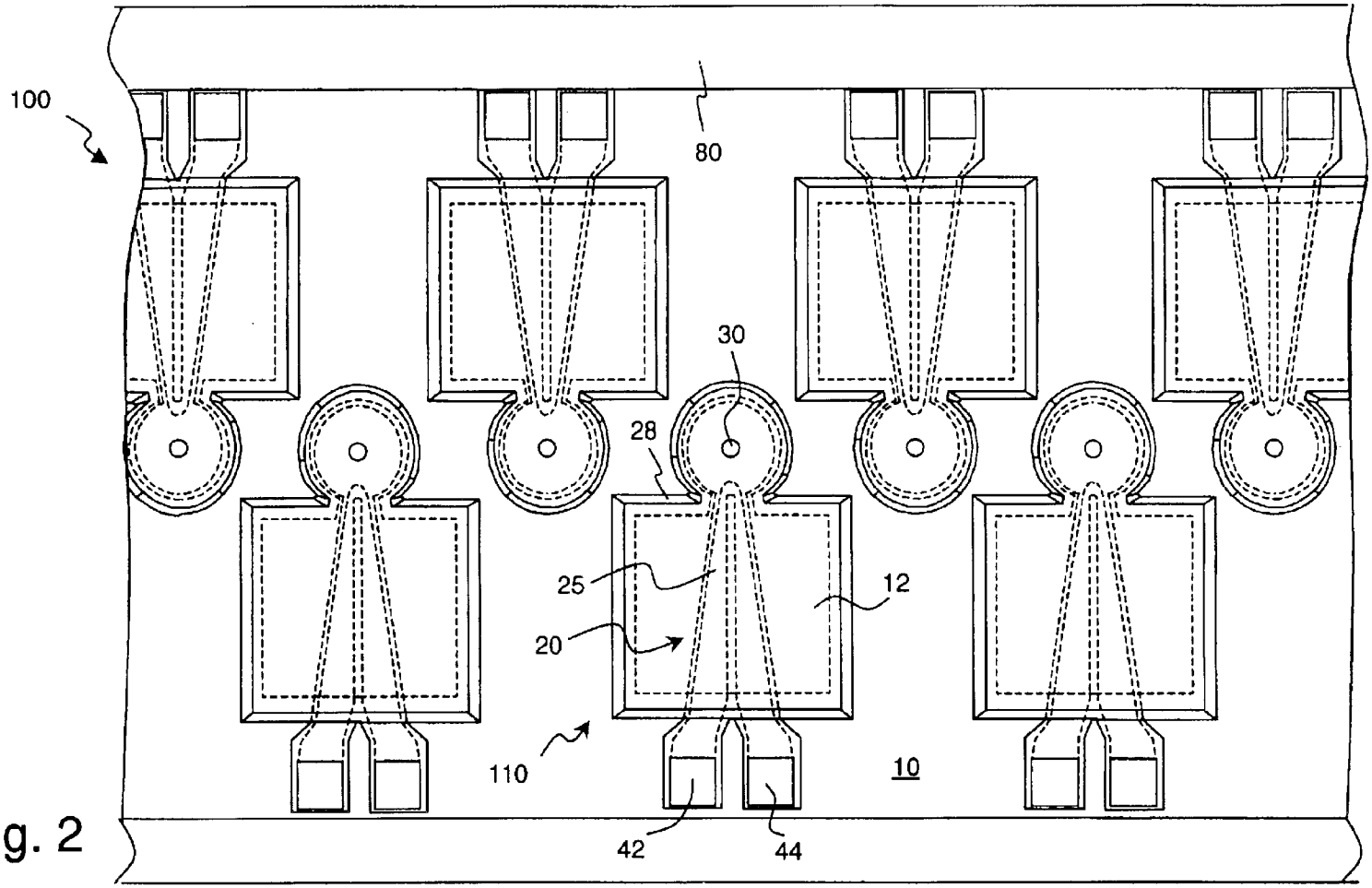
FIG. 2 is a plan view of an array of ink jet units or liquid drop emitter units according to the present invention.

FIG. 2 shows a plan view of a portion of ink jet printhead 100. An array of thermally actuated ink jet units 110 is shown having nozzles 30 centrally aligned, and ink chambers 12, interdigitated in two rows. The ink jet units 110 are formed on and in a substrate 10 using microelectronic fabrication methods. An example fabrication sequence which may be used to form drop emitters 110 is described in co-pending application Ser. No. 09/726,945 filed Nov. 30, 2000, for "Thermal Actuator", assigned to the assignee of the present invention.

Each drop emitter unit 110 has associated electrical lead contacts 42, 44 which are formed with, or are electrically connected to, a heater resistor portion 25, shown in phantom view in FIG. 2. In the illustrated embodiment, the heater resistor portion 25 is formed in a first layer of a cantilevered element 20 of a thermal actuator and participates in the thermo-mechanical effects as will be described. Element 80 of the printhead 100 is a mounting structure which provides a mounting surface for microelectronic substrate 10 and other means for interconnecting the liquid supply, electrical signals, and mechanical interface features.

Figure 3A:
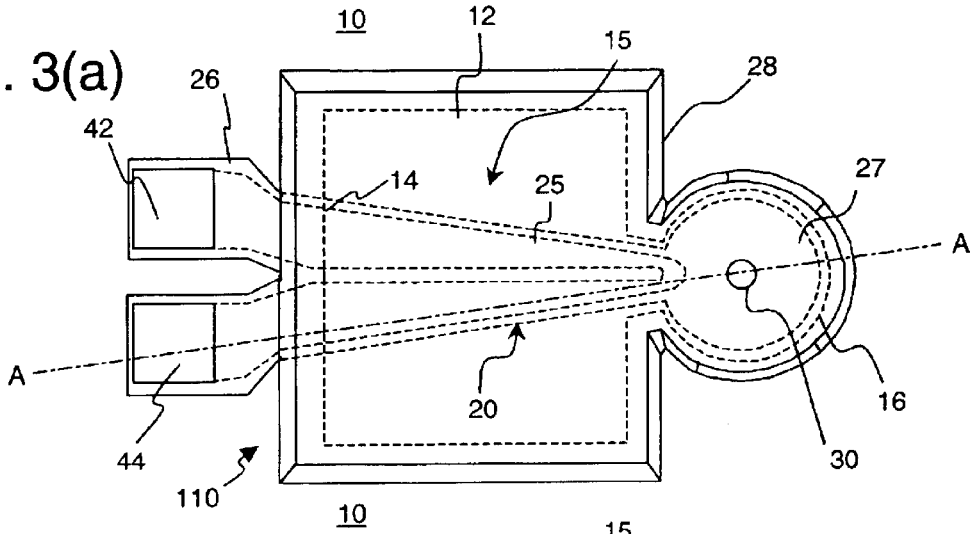
FIGS. 3(*a*) and 3(*b*) are enlarged plan views of an individual ink jet unit shown in FIG. 2.
Figure 3B:
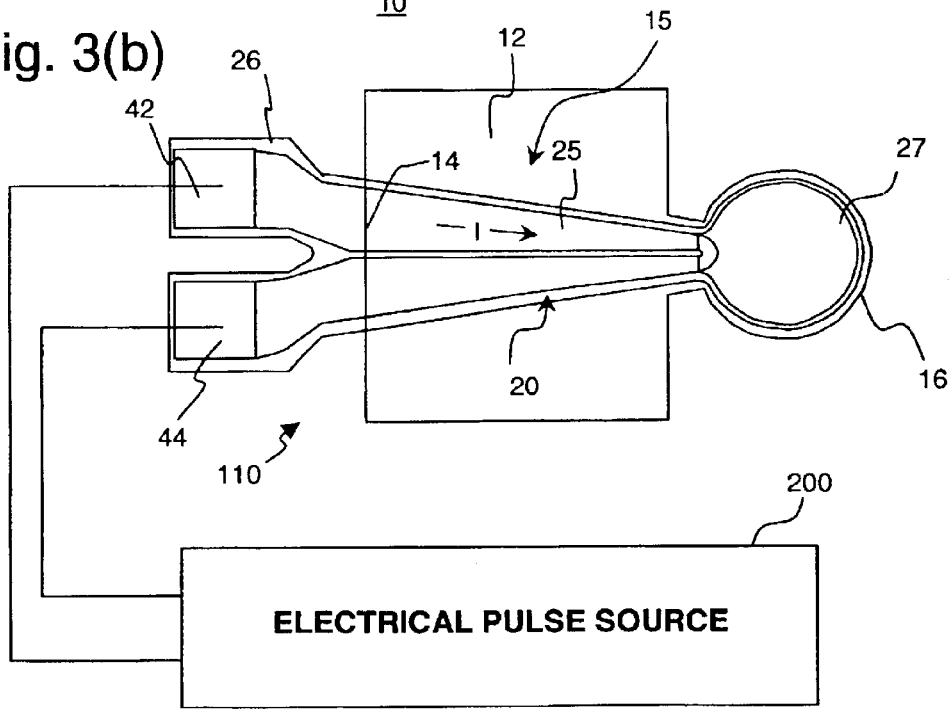

FIG. 3*a* illustrates a plan view of a single drop emitter unit 110 and a second plan view FIG. 3*b* with the liquid chamber cover 28, including nozzle 30, removed.

The thermal actuator 15, shown in phantom in FIG. 3*a* can be seen with solid lines in FIG. 3*b*. The cantilevered element 20 of thermal actuator 15 extends from base element edge 14 of liquid chamber 12 which is formed in substrate base element 10. Cantilevered element anchor portion 26 is bonded to base element substrate 10 and anchors the cantilever.

The cantilevered element 20 of the actuator has the shape of a paddle, an extended, tapered flat shaft ending with a disc of larger diameter than the final shaft width. This shape is merely illustrative of cantilever actuators which can be used, many other shapes are applicable as will be described hereinbelow. The disc-shape aligns the nozzle 30 with the center of the cantilevered element free end portion 27. The fluid chamber 12 has a curved wall portion at 16 which conforms to the curvature of the free end portion 27, spaced away to provide clearance for the actuator movement.

FIG. 3*b* illustrates schematically the attachment of electrical pulse source 200 to the resistive heater 25 at interconnect terminals 42 and 44. Voltage differences are applied to voltage terminals 42 and 44 to cause resistance heating via heater resistor 25. This is generally indicated by an arrow showing a current I. In the plan views of FIG. 3, the actuator free end portion 27 moves toward the viewer when pulsed and drops are emitted toward the viewer from the nozzle 30 in cover 28. This geometry of actuation and drop emission is called a "roof shooter" in many ink jet disclosures.

Figure 4A:
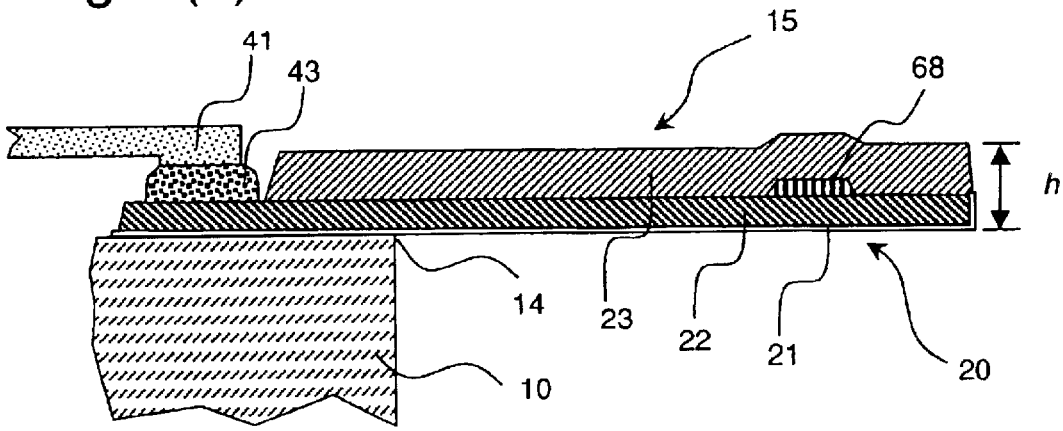
FIGS. 4(*a*) and 4(*b*) are side views illustrating the movement of a thermal actuator according to the present invention.
Figure 4B:
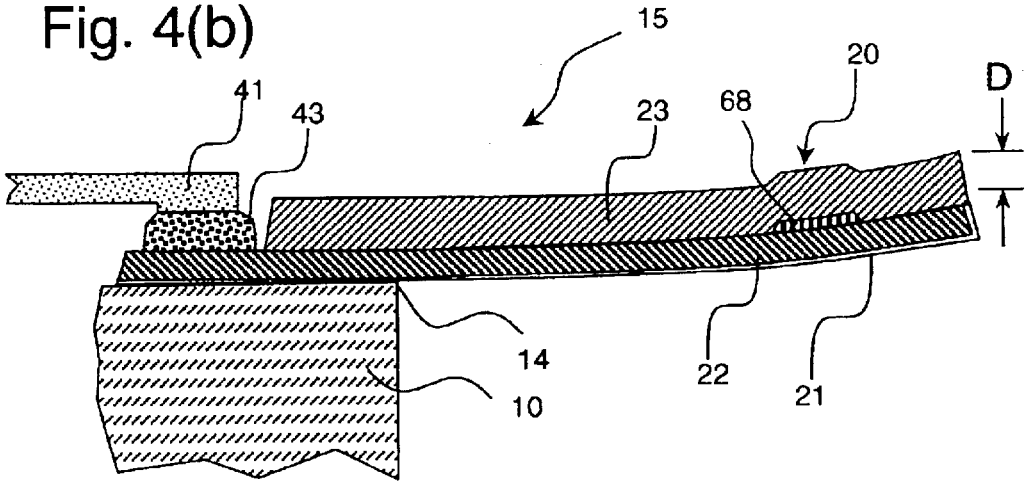

FIG. 4 illustrates in side view a cantilevered thermal actuator 15 according to a preferred embodiment of the present invention. In FIG. 4*a* the actuator is in a first position and in FIG. 4*b* it is shown deflected upward to a second position. Cantilevered element 20 extends from an anchor location 14 of base element 10. The cantilevered element 20 is constructed of several layers. First layer 22 causes the upward deflection when it is thermally elongated with respect to other layers in the cantilevered element 20. It is constructed of an electrically resistive material, preferably intermetallic titanium aluminide, that has a large coefficient of thermal expansion.

A current coupling device 68 is illustrated in side view in FIG. 4. The current coupling device conducts current serially between two elongated resistor segments of heater resistor 25 and may be formed by depositing and patterning a metallic layer such as aluminum or by using the electrically resistive material.

The cantilevered element 20 also includes a second layer 23, attached to the first layer 22. The second layer 23 is constructed of a second material having a low coefficient of thermal expansion, with respect to the material used to construct the first layer 22. The thickness of second layer 23 is chosen to provide the desired mechanical stiffness and to maximize the deflection of the cantilevered element for a given input of heat energy. Second layer 23 may also be a dielectric insulator to provide electrical insulation for resistive heater segments and current coupling devices and segments formed into the first layer or in a third material used in some preferred embodiments of the present inventions. The second layer may be used to partially define electroresistor and current coupler devices formed as portions of first layer 22 or in an added conductive layer.

Second layer 23 may be composed of sub-layers, laminations of more than one material, so as to allow optimization of functions of heat flow management, electrical isolation, and strong bonding of the layers of the cantilevered element 20.

Passivation layer 21 shown in FIG. 4 is provided to protect the first layer 22 chemically and electrically. Such protection may not be needed for some applications of thermal actuators according to the present invention, in which case it may be deleted. Liquid drop emitters utilizing thermal actuators which are touched on one or more surfaces by the working liquid may require passivation layer 21 which is chemically and electrically inert to the working liquid.

The overall thickness, h, of cantilevered element 20 is indicated in FIG. 4. In the immediate area of current coupling device 68 it may be somewhat thicker if an added material is used to form the current coupler.

A heat pulse is applied to first layer 22, causing it to rise in temperature and elongate. Second layer 23 does not elongate nearly as much because of its smaller coefficient of thermal expansion and the time required for heat to diffuse from first layer 22 into second layer 23. The difference in length between first layer 22 and the second layer 23 causes the cantilevered element 20 to bend upward an amount D, as illustrated in FIG. 4*b*. When used as an actuator in a drop emitter, the bending response of the cantilevered element 20 must be rapid enough to sufficiently pressurize the liquid at the nozzle. Typically, electroresistive heating apparatus is adapted to apply heat pulses, and an electrical pulse duration of less than 4 $\mu$secs. is used and, preferably, a duration less than 2 $\mu$secs.

FIGS. 5 through 10 illustrate fabrication processing steps for constructing a single liquid drop emitter according to some of the preferred embodiments of the present invention. For these embodiments the first layer 22 is constructed using an electrically resistive material, such as titanium aluminide, and a portion is patterned into a resistor for carrying electrical current, I.

Figure 5:
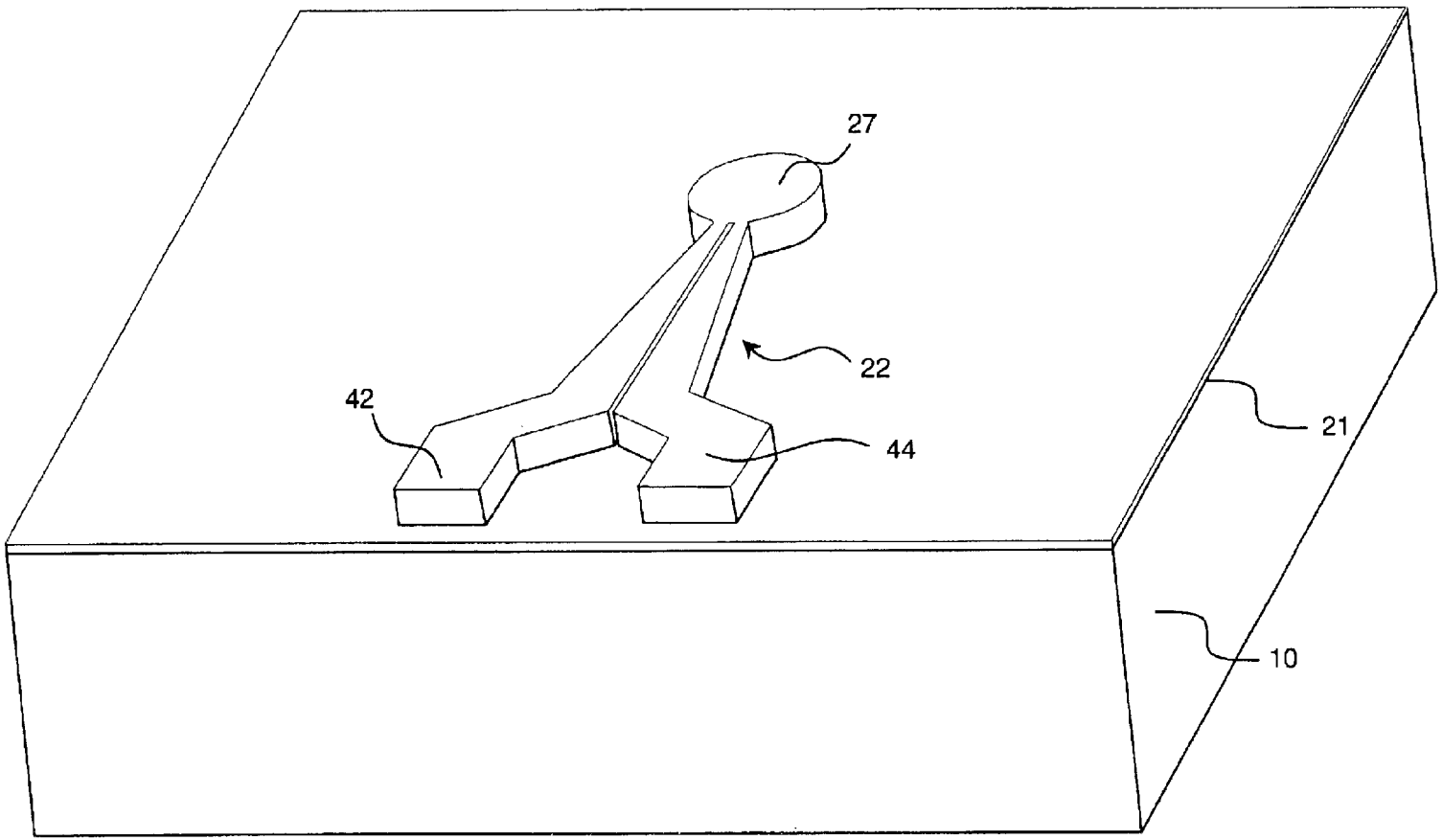
FIG. 5 is a perspective view of the early stages of a process suitable for constructing a thermal actuator according to the present invention wherein a first layer of electrically resistive material of the cantilevered element is formed.

FIG. 5 illustrates a first layer 22 of a cantilever in a first stage of fabrication. The illustrated structure is formed on a substrate 10, for example, single crystal silicon, by standard microelectronic deposition and patterning methods. A portion of substrate 10 will also serve as a base element from which cantilevered element 20 extends. Deposition of intermetallic titanium aluminide may be carried out, for example, by RF or pulsed DC magnetron sputtering. An example deposition process that may be used for titanium aluminide is described in co-pending application Ser. No. 09/726,945 filed Nov. 30, 2000, for "Thermal Actuator", assigned to the assignee of the present invention.

After first layer 22 is deposited it is patterned by removing material to create desired shapes for thermo-mechanical performance as well as an appropriate electrical current path for purposes of applying a heat pulse. A cantilever free end portion 27 is illustrated. Addressing electrical leads 42 and 44 are illustrated as being formed in the first layer 22 material as well. Leads 42, 44 may make contact with circuitry previously formed in base element substrate 10 or may be contacted externally by other standard electrical interconnection methods, such as tape automated bonding (TAB) or wire bonding. A passivation layer 21 is formed on substrate 10 before the deposition and patterning of the first layer 22 material. This passivation layer may be left under first layer 22 and other subsequent structures or removed in a subsequent patterning process.

Figure 6:
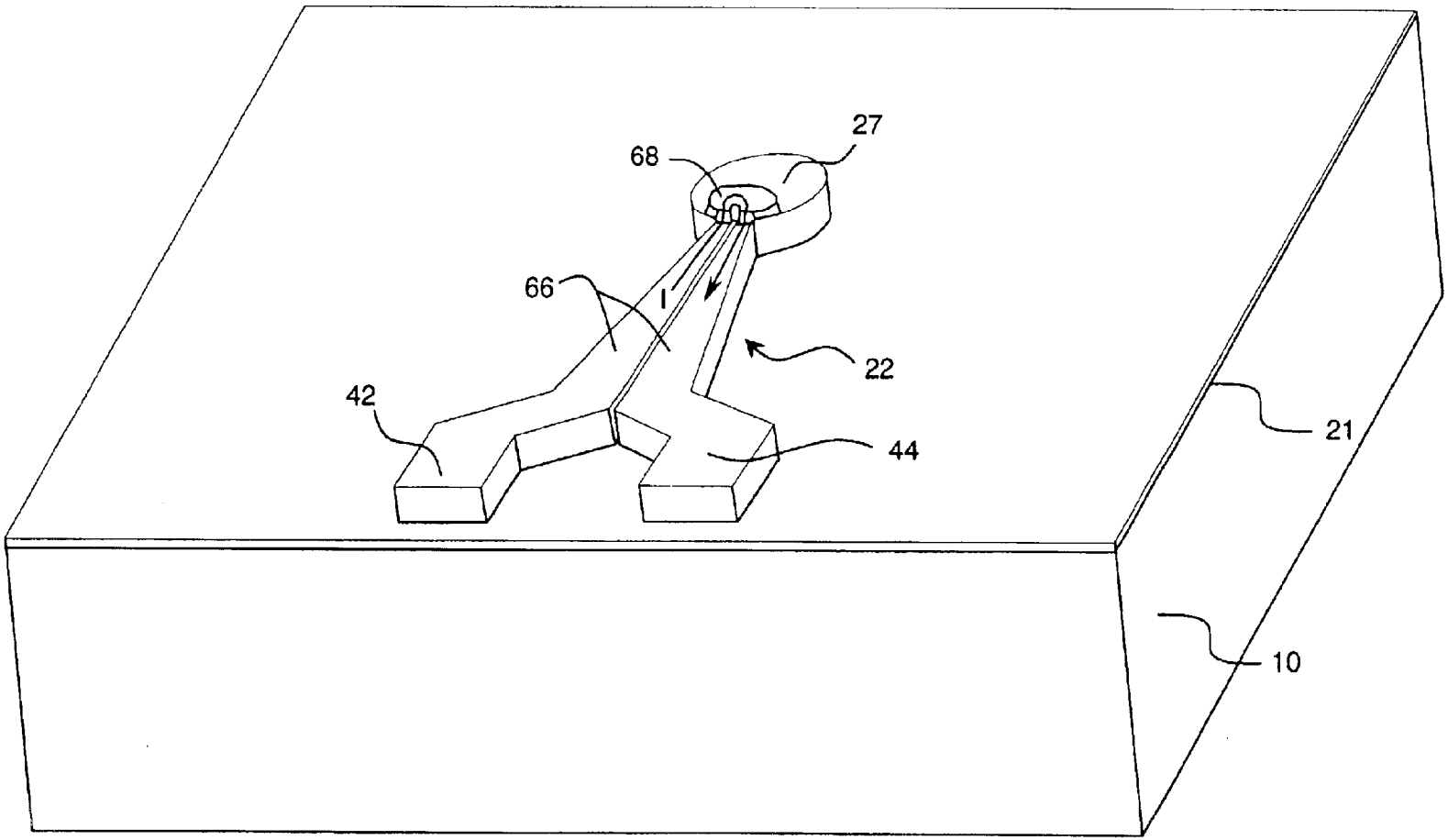
FIG. 6 is a perspective view of a next stage of the process illustrated in FIG. 5 wherein a current coupling device is added.

FIG. 6 illustrates a next step in the fabrication process following the step illustrated previously. In this step a current coupling device 68 is formed at the location where the free end portion 27 joins the shaft of the cantilevered element. In the illustrated embodiment, the current coupling device 68 is formed by depositing and patterning a conductive material which serially conducts current between elongated heater resistor segments 66. The heat pulse activation current path is indicated by an arrow and letter "I". The coupler segment 68 reverses the direction of current and serves to define the outer end of the directly heated portion of the cantilevered element.

Figure 7:
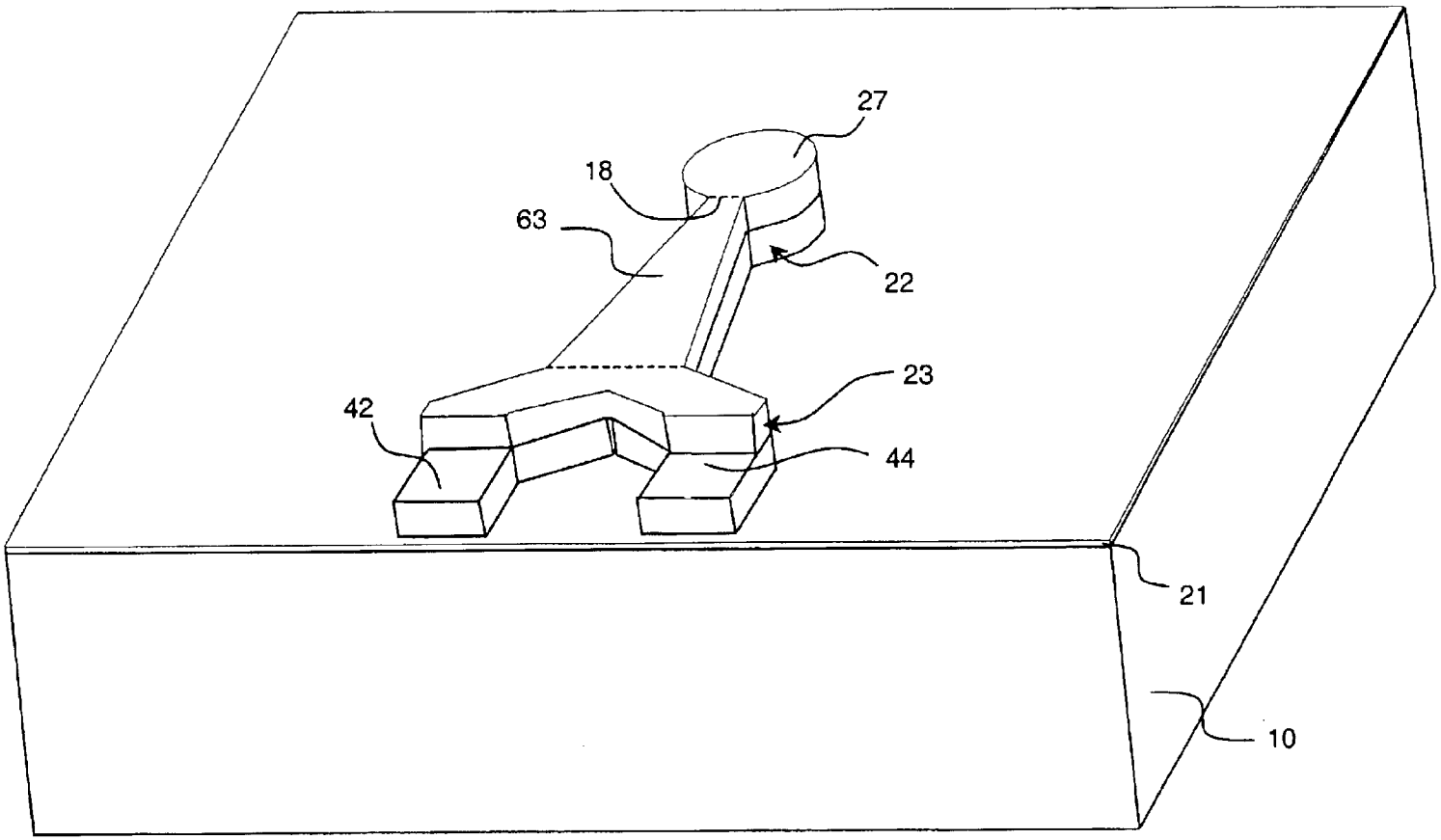
FIG. 7 is a perspective view of the next stages of the process illustrated in FIG. 5 or 6 wherein a second layer of a dielectric material of the cantilevered element is formed.

FIG. 7 illustrates a second layer 23 having been deposited and patterned over the previously formed first layer 22 portion of the thermal actuator. Second layer 23 also covers the current coupling device 68. Second layer 23 is formed over the first layer 22 covering the remaining resistor pattern including resistor segments 66. The second layer 23 material has low coefficient of thermal expansion compared to the material of first layer 22. For example, second layer 23 may be silicon dioxide, silicon nitride, aluminum oxide or some multi-layered lamination of these materials or the like.

In FIG. 7, a trapezoidal-shaped portion of the cantilevered element is illustrated extending between dotted lines. The indicated portion is a thermo-mechanical bending device comprised of high thermal expansion layer 22 and low thermal expansion layer 23. Later, when released from substrate 10, thermo-mechanical bending portion 68 will bend upward when an electrical pulse is applied to the heater resistor 25 formed in first layer 22.

Additional passivation materials may be applied at this stage over the second layer 23 for chemical and electrical protection. Also, the initial passivation layer 21 is patterned away from areas through which fluid will pass from openings to be etched in substrate 10.

Figure 8:
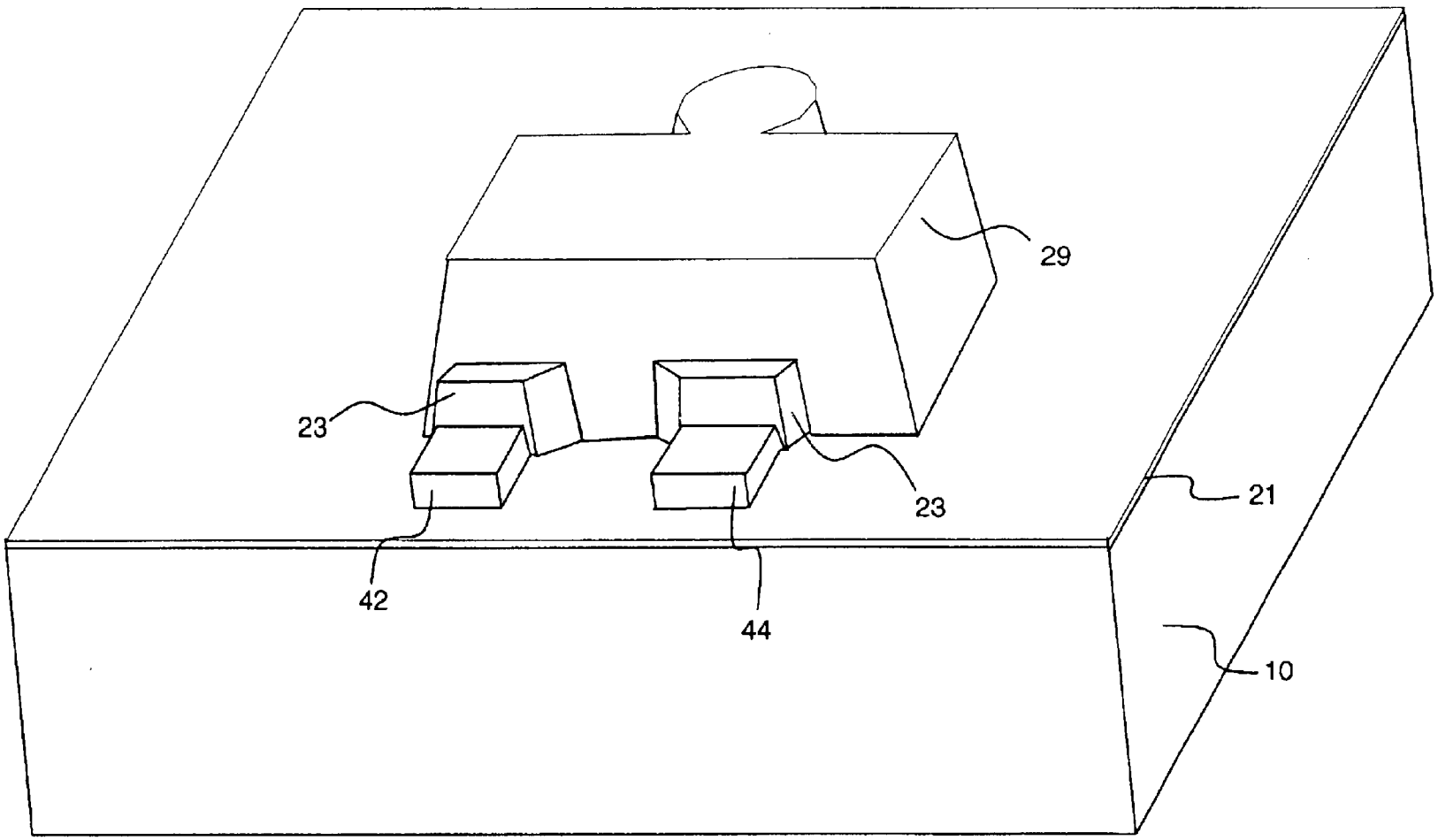
FIG. 8 is a perspective view of the next stages of the process illustrated in FIGS. 5–7 wherein a sacrificial layer in the shape of the liquid filling a chamber of a drop emitter according to the present invention is formed.

FIG. 8 shows the addition of a sacrificial layer 29 which is formed into the shape of the interior of a chamber of a liquid drop emitter. A suitable material for this purpose is polyimide. Polyimide is applied to the device substrate in sufficient depth to also planarize the surface which has the topography of the first 22 and second 23 layers as illustrated in FIGS. 5–7. Any material which can be selectively removed with respect to the adjacent materials may be used to construct sacrificial structure 29.

Figure 9:
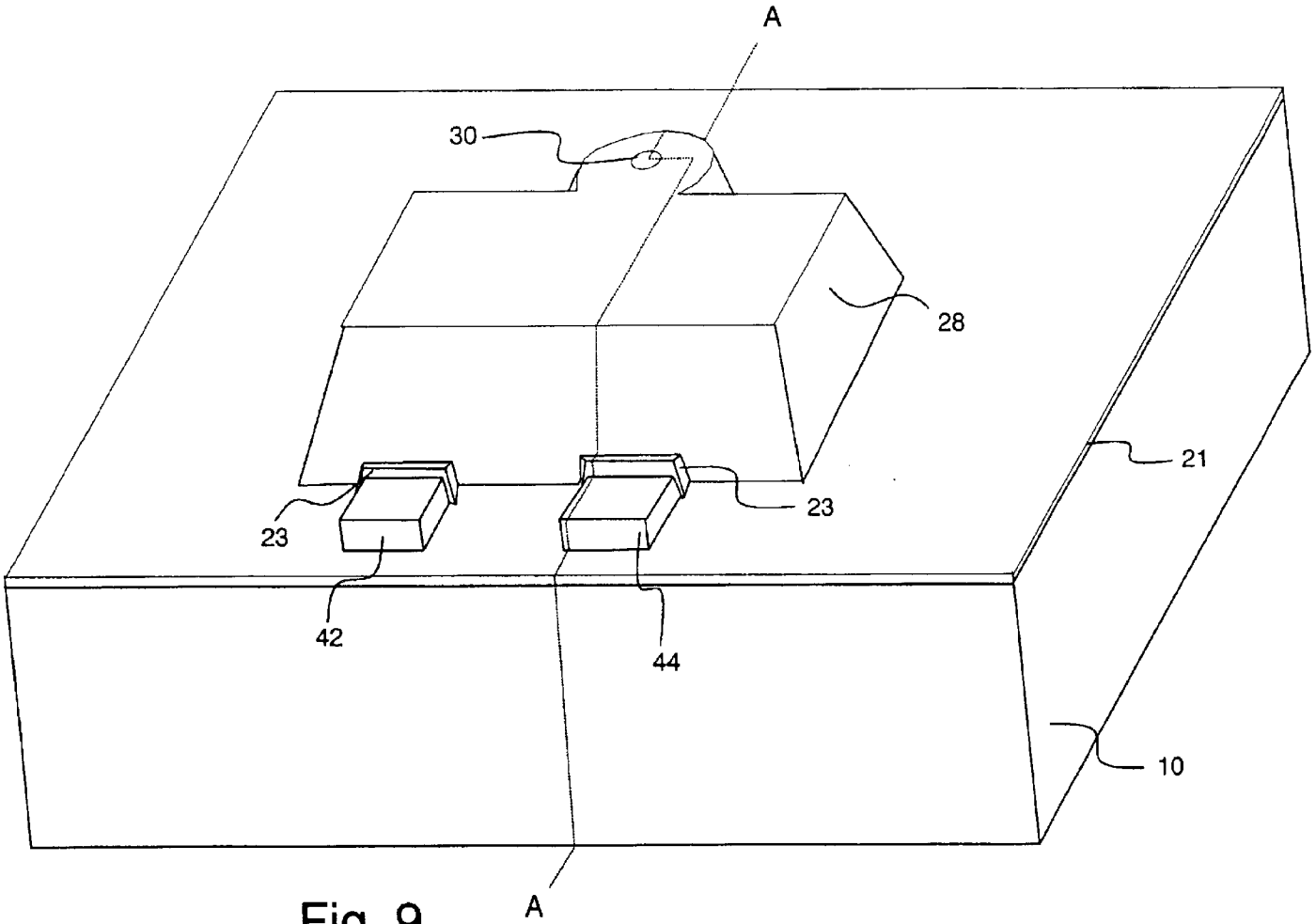
FIG. 9 is a perspective view of the next stages of the process illustrated in FIGS. 5–8 wherein a liquid chamber and nozzle of a drop emitter according to the present invention is formed.

FIG. 9 illustrates drop emitter liquid chamber walls and cover formed by depositing a conformal material, such as plasma deposited silicon oxide, nitride, or the like, over the sacrificial layer structure 29. This layer is patterned to form drop emitter chamber 28. Nozzle 30 is formed in the drop emitter chamber, communicating to the sacrificial material layer 29, which remains within the drop emitter chamber 28 at this stage of the fabrication sequence.

Figure 10A:
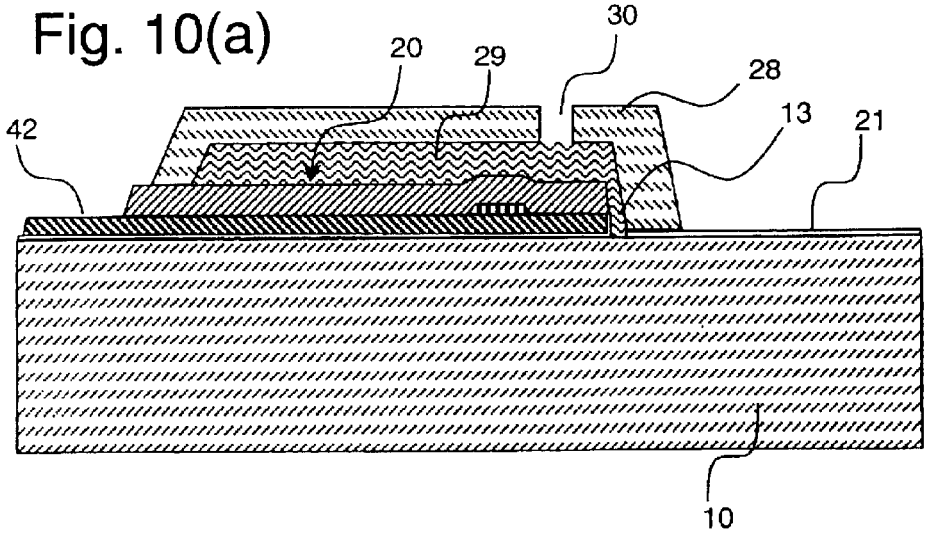
FIGS. 10(*a*)–10(*c*) are side views of the final stages of the process illustrated in FIGS. 5–9 wherein a liquid supply pathway is formed and the sacrificial layer is removed to complete a liquid drop emitter according to the present invention.

FIG. 10 shows a side view of the device through a section indicated as A—A in FIG. 9. In FIG. 10*a* the sacrificial layer 29 is enclosed within the drop emitter chamber walls 28 except for nozzle opening 30. Also illustrated in FIG. 10*a*, the substrate 10 is intact. Passivation layer 21 has been removed from the surface of substrate 10 in gap area 13 and around the periphery of the cantilevered element 20. The removal of layer 21 in these locations was done at a fabrication stage before the forming of sacrificial structure 29.

Figure 10B:
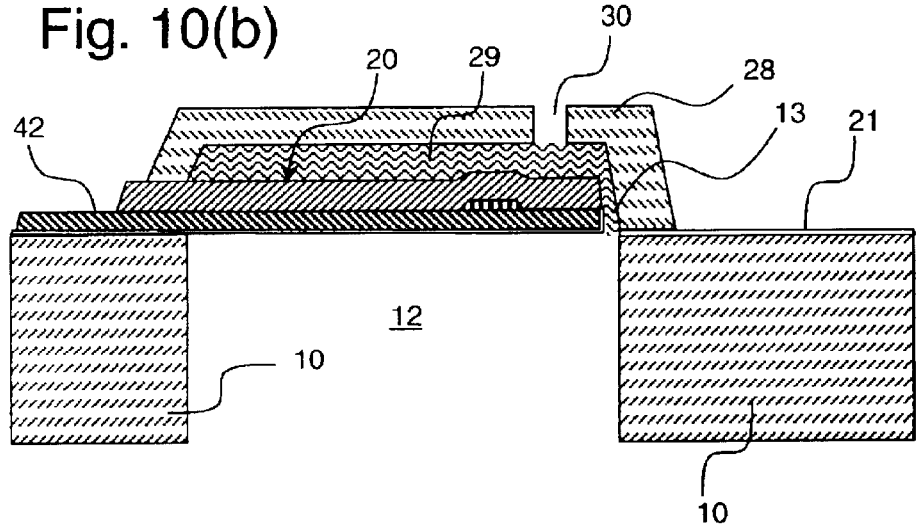

In FIG. 10*b*, substrate 10 is removed beneath the cantilever element 20 and the liquid chamber areas around and beside the cantilever element 20. The removal may be done by an anisotropic etching process such as reactive ion etching, or such as orientation dependent etching for the case where the substrate used is single crystal silicon. For constructing a thermal actuator alone, the sacrificial structure and liquid chamber steps are not needed and this step of etching away substrate 10 may be used to release the cantilevered element 20.

Figure 10C:
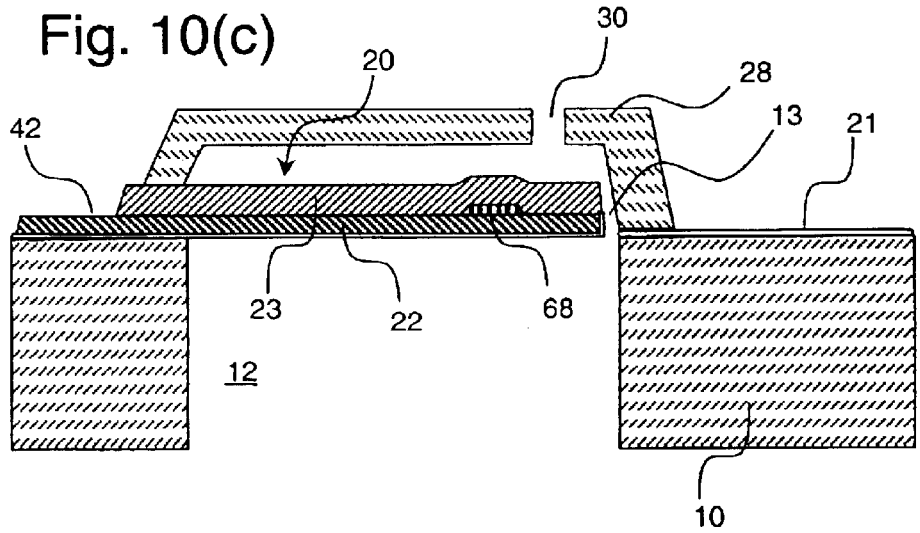

In FIG. 10*c* the sacrificial material layer 29 has been removed by dry etching using oxygen and fluorine sources. The etchant gasses enter via the nozzle 30 and from the newly opened fluid supply chamber area 12, etched previously from the backside of substrate 10. This step releases the cantilevered element 20 and completes the fabrication of a liquid drop emitter structure.

Figure 11A:
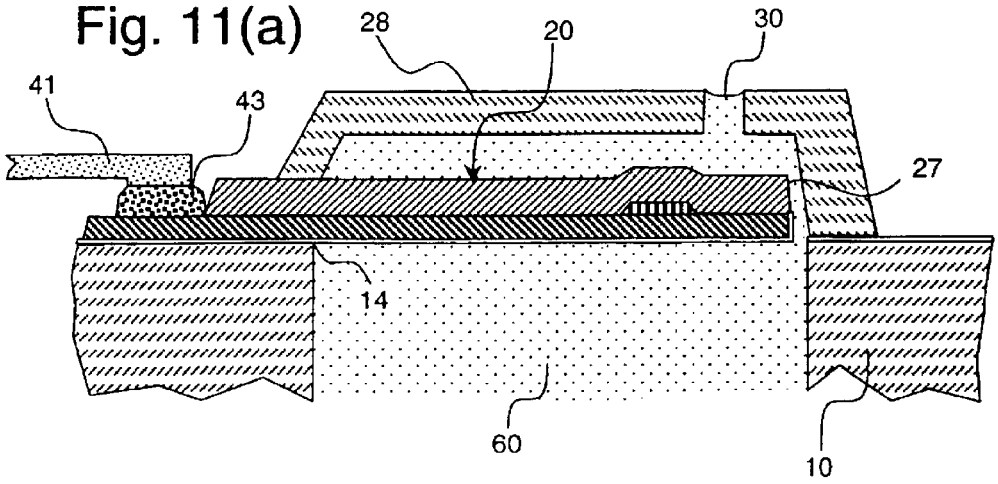
FIGS. 11(*a*) and 11(*b*) are side views illustrating the operation of a drop emitter according the present invention.
Figure 11B:
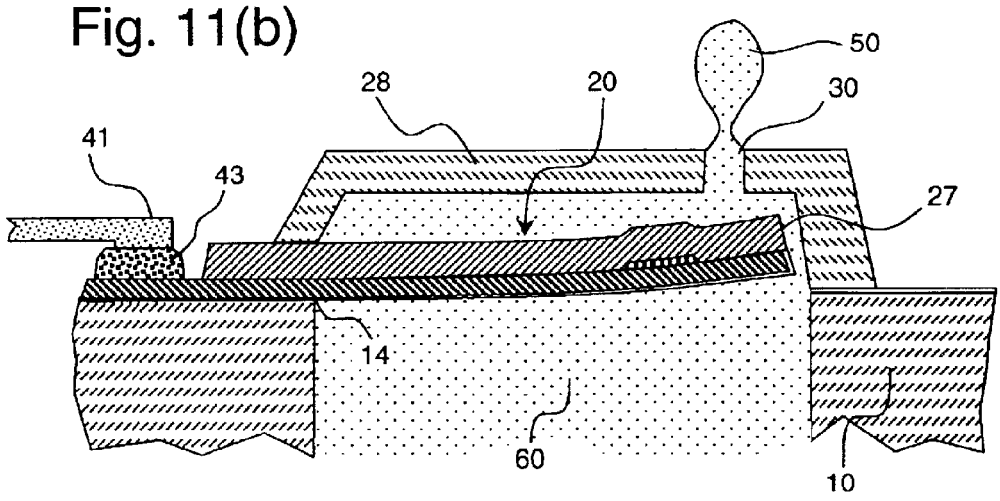

FIG. 11 illustrates a side view of a liquid drop emitter structure according to some preferred embodiments of the present invention. FIG. 11*a* shows the cantilevered element 20 in a first position proximate to nozzle 30. FIG. 11*b* illustrates the deflection of the free end 27 of the cantilevered element 20 towards nozzle 30. Rapid deflection of the cantilevered element to this second position pressurizes liquid 60 causing a drop 50 to be emitted.

In an operating emitter of the cantilevered element type illustrated, the quiescent first position may be a partially bent condition of the cantilevered element 20 rather than the horizontal condition illustrated FIG. 11*a*. The actuator may be bent upward or downward at room temperature because of internal stresses that remain after one or more microelectronic deposition or curing processes. The device may be operated at an elevated temperature for various purposes, including thermal management design and ink property control. If so, the first position may be as substantially bent as is illustrated in FIG. 11*b*.

For the purposes of the description of the present invention herein, the cantilevered element will be said to be quiescent or in its first position when the free end is not significantly changing in deflected position. For ease of understanding, the first position is depicted as horizontal in FIG. 4*a* and FIG. 11*a*. However, operation of thermal actuators about a bent first position are known and anticipated by the inventors of the present invention and are fully within the scope of the present inventions.

FIGS. 5 through 10 illustrate a preferred fabrication sequence. However, many other construction approaches may be followed using well known microelectronic fabrication processes and materials. For the purposes of the present invention, any fabrication approach which results in a cantilevered element including a thermo-mechanical bending portion may be followed. In addition, the thermo-mechanical bending portion may be heated by other apparatus adapted to apply a heat pulse. For example, a thin film resistor may be formed beneath or above the thermo-mechanical bending portion and electrically pulsed to apply heat. Alternatively, heating pulses may be applied to the thermo-mechanical bending portion by light energy or electromagnetic coupling.

In the illustrated sequence of FIGS. 5 through 10, the liquid chamber 28 and nozzle 30 of a liquid drop emitter were formed in situ on substrate 10. Alternatively a thermal actuator could be constructed separately and bonded to a liquid chamber component to form a liquid drop emitter.

The inventors of the present inventions have discovered that the efficiency of a cantilevered element thermal actuator is importantly influenced by the shape of the thermal bending portion. The cantilevered element is designed to have a length sufficient to result in an amount of deflection sufficient to meet the requirements of the microelectronic device application, be it a drop emitter, a switch, a valve, light deflector, or the like. The details of thermal expansion differences, stiffness, thickness and other factors associated with the layers of the thermo-mechanical bending portion are considered in determining an appropriate length for the cantilevered element.

The width of the cantilevered element is important in determining the force which is achievable during actuation. For most applications of thermal actuators, the actuation must move a mass and overcome counter forces. For example, when used in a liquid drop emitter, the thermal actuator must accelerate a mass of liquid and overcome backpressure forces in order to generate a pressure pulse sufficient to emit a drop. When used in switches and valves the actuator must compress materials to achieve good contact or sealing.

In general, for a given length and material layer construction, the force that may be generated is proportional to the width of the thermo-mechanical bending portion of the cantilevered element. A straightforward design for a thermo-mechanical bender is therefore a rectangular beam of width $w_0$ and length L, wherein L is selected to produce adequate actuator deflection and $w_0$ is selected to produce adequate force of actuation, for a given set of thermo-mechanical materials and layer constructions.

It has been found by the inventors of the present inventions that the straightforward rectangular shape mentioned above is not the most energy efficient shape for the thermo-mechanical bender. Rather, it has been discovered that a thermo-mechanical bending portion that reduces in width from the anchored end of the cantilevered element to a narrower width at the free end, produces more force for a given area of the bender.

Figure 12A:
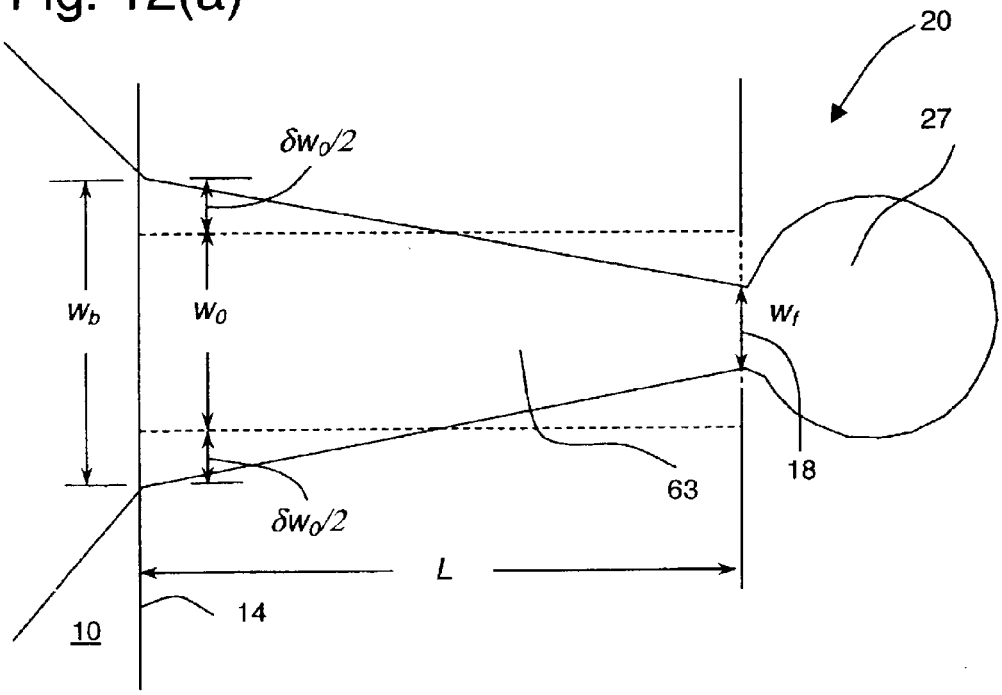
FIGS. 12(*a*) and (*b*) are plan views of alternative designs for a thermo-mechanical bending portion according to the present inventions.
Figure 12:
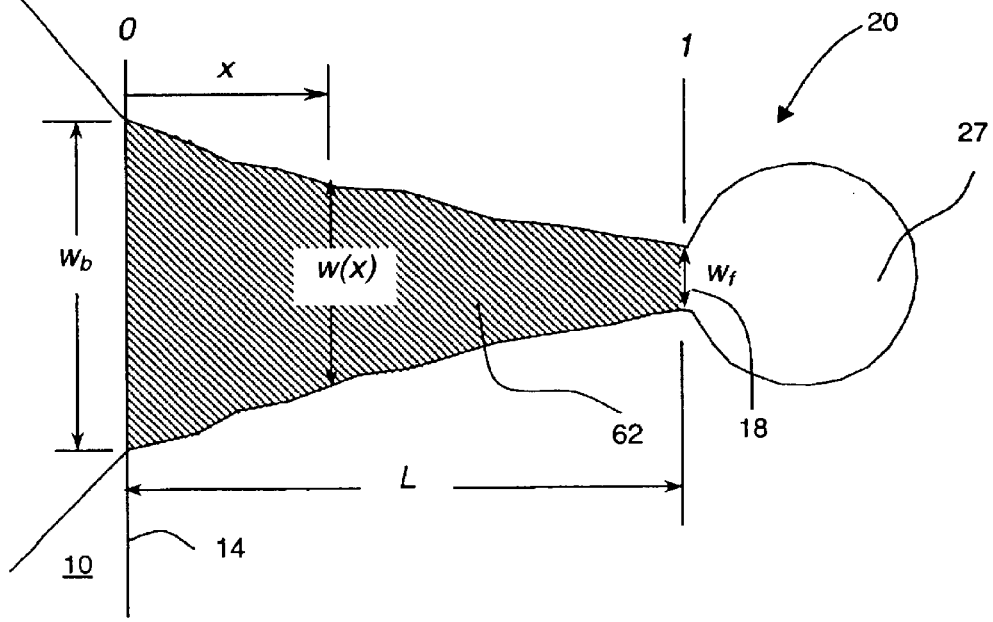

FIG. 12*a* illustrates a cantilevered element 27 and thermo-mechanical bending portion 63 according to the present invention. Thermo-mechanical bending portion 63 extends from the base element anchor location 14 to a location of connection 18 to free end portion 27. The width of the thermo-mechanical bending portion is substantially greater at the base end, $w_b$, than at the free end, $w_f$. In FIG. 12*a*, the width of the thermo-mechanical bender decreases linearly from $w_b$ to $w_f$ producing a trapezoidal shaped thermo-mechanical bending portion. Also illustrated in FIG. 12*a*, $w_b$ and $w_f$ are chosen so that the area of the trapezoidal thermo-mechanical bending portion 63, is equal to the area of a rectangular thermo-mechanical bending portion, shown in phantom in FIG. 12*a*, having the same length L and a width $w_0=\frac{1}{2}(w_b+w_f)$.

The linear tapering shape illustrated in FIG. 12*a* is a special case of a generally tapering shape according to the present inventions and illustrated in FIG. 12*b*. Generally tapering thermo-mechanical bending portion 62, illustrated in FIG. 12*b*, has a width, w(x), which decreases monotonically as a function of the distance, x, from $w_b$ at anchor location 14 at base element 10, to $w_f$ at the location of connection 18 to free end portion 27 at distance L. In FIG. 12*b*, the distance variable x, over which the thermo-mechanical bending portion 62 monotonically reduces in width, is expressed as covering a range $x=0\rightarrow 1$, i.e. in units normalized by length L.

Figure 13:
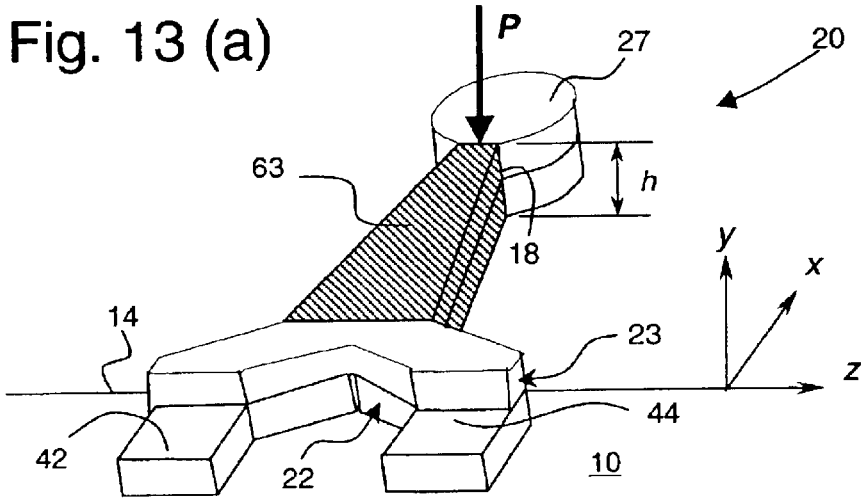
FIGS. 13(*a*) and 13(*b*) are perspective and plan views of a design for a thermo-mechanical bending portion according to the present inventions.

The beneficial effect of a taper-shaped thermo-mechanical bending portion 62 or 63 may be understood by analyzing the resistance to bending of a beam having such a shape. FIG. 13 illustrates a first shape that can be explored analytically in closed form. FIG. 13*a* shows in perspective view a cantilevered element 20 comprised of first and second layers 22 and 23. A linearly-tapered (trapezoidal) thermo-mechanical bending portion 63 extends from anchor location 14 of base element 10 to a free end portion 27. A force, P, representing a load or backpressure, is applied perpendicularly, in the negative y-direction in FIG. 13, to the free end 18 of thermo-mechanical bending portion 63 where it joins to free end portion 27 of the cantilevered element.

Figure 13B:
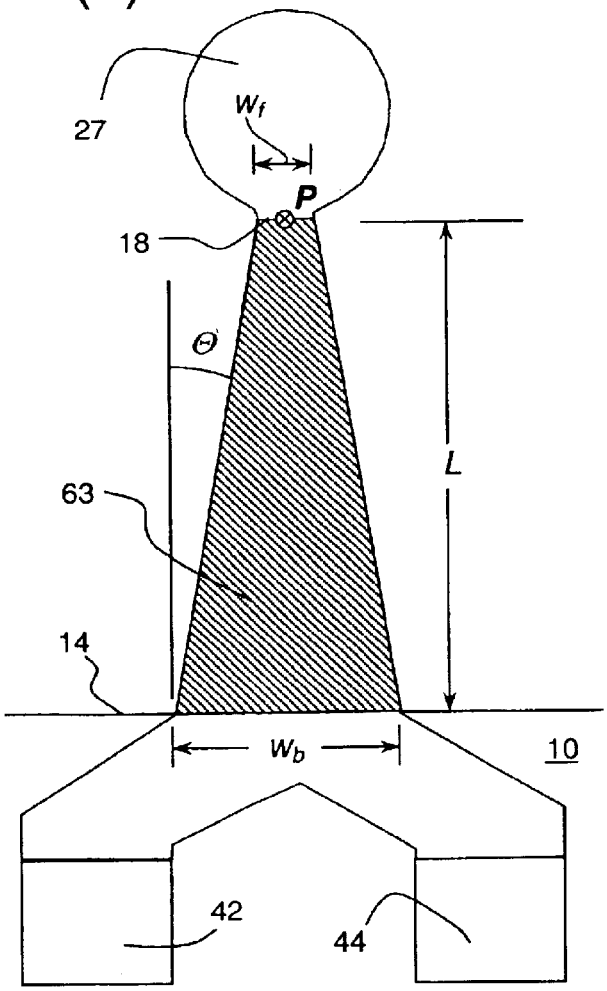

FIG. 13*b* illustrates in plan view the geometrical features of a trapezoidal thermo-mechanical bending portion 63 that are used in the analysis hereinbelow. Note that the amount of linear taper is expressed as an angle Θ in FIG. 13*b* and as a difference width, $\delta w_0/2$, in FIG. 12*b*. These two descriptions of the taper are related as follows: $\tan\Theta=\delta w_0/L$.

Thermo-mechanical bending portion 63, fixed at anchor location 14 (x=0) and impinged by force P at free end 18 (x=L) assumes an equilibrium shape based on geometrical parameters, including the overall thickness h, and the effective Young's modulus, E, of the multi-layer structure. The anchor connection exerts a force, oppositely directed to the force P, on the cantilevered element that prevents it from translating. Therefore the net moment, M(x), acting on the thermo-mechanical bending portion at a distance, x from the fixed base end is:

$$M(x)=Px-PL. \tag{1}$$

The thermo-mechanical bending portion 63 resists bending in response to the applied moment, M(x), according to geometrical shape factors expressed as the beam stiffness I(x) and Young's modulus, E. Therefore:

$$EI(x)\frac{d^2y}{dx^2}=M(x),\text{ where} \tag{2}$$

$$I(x)=\frac{1}{12}w(x)h^3.\text{ Combining with Eq. 1:} \tag{3}$$

$$\frac{d^2y}{dx^2}=\frac{12PL^3}{Eh^3}\frac{(x-1)}{w(x)}. \tag{4}$$

Equation 4 above is a differential equation in y(x), the deflection of the thermo-mechanical bending member as a function of the geometrical parameters, materials parameters and distance out from the fixed anchor location, x, expressed in units of L. Equation 4 may be solved for y(x) using the boundary conditions y(0)=dy(0)/dx=0.

It is useful to solve Equation 4 initially for a rectangular thermo-mechanical bending portion to establish a base or nominal case for comparison to the reducing width shapes of the present inventions. Thus, for the rectangular shape illustrated in phantom lines in FIG. 12*a*, $$w(x) = w_0,\ 0 \le x \le 1.0, \tag{5}$$

$$\frac{d^2y}{dx^2} = \frac{12PL^3}{Eh^3}\frac{(x-1)}{w_0}, \tag{6}$$

$$y(x) = C_0\left(\frac{x^3}{6} - \frac{x^2}{2}\right), \text{ where,} \tag{7}$$

$$C_0 = \frac{12PL^3}{Eh^3 w_0}. \tag{8}$$

At the free end of the rectangular thermo-mechanical bending portion 63, x=1.0, the deflection of the beam, y(1), in response to a load P is therefore:

$$y(1) = -\frac{1}{3}C_0. \tag{9}$$

The deflection of the free end location 18 of a rectangular thermo-mechanical bending portion, y(1), expressed in above Equation 9, will be used in the analysis hereinbelow as a normalization factor. That is, the amount of deflection under a load P of thermo-mechanical bending portions having reducing widths according to the present inventions, will be analyzed and compared to the rectangular case. It will be shown that the thermo-mechanical bending portions of the present inventions are deflected less by an equal load or backpressure than a rectangular thermo-mechanical bending portion having the same length, L, and average width, $w_0$. Because the shapes of the thermo-mechanical bending portions according to the present inventions are more resistant to load forces and backpressure forces, more deflection and more forceful deflection can be achieved by the input of the same heat energy as compared to a rectangular thermo-mechanical bender.

Trapezoidal-shaped thermo-mechanical bending portions, as illustrated in FIGS. 2, 3, 12, and 13 are preferred embodiments of the present inventions. The thermo-mechanical bending portion 63 is designed to narrow from a base end width, $w_b$, to a free end width, $w_f$, in a linear function of x, the distance out from the anchor location 14 of base element 10. Further, to clarify the improved efficiencies that are obtained, the trapezoidal-shaped thermo-mechanical bending portion is designed to have the same length, L, and area, $w_0L$, as the rectangular-shaped thermo-mechanical bending portion described by above Equation 5. The trapezoidal-shape width function, w(x), may be expressed as:

$$w(x)=w_0(ax+b),\ 0 \le x \le 1.0, \tag{10}$$

where $(w_f+w_b)/2=w_0$, $\delta=(w_b-w_f)/2w_0$, $a=-2\delta$, and $b=(1+\delta)$ Inserting the linear width function, Equation 10, into differential Equation 4 allows the calculation of the deflection of trapezoidal-shaped thermo-mechanical bending portion 63, y(x), in response to a load P at the free end location 18:

$$\frac{d^2y}{dx^2} = \frac{12PL^3}{Eh^3 w_0}\frac{(x-1)}{(ax+b)}, \tag{11}$$

$$y(x) = C_0\left\{-\frac{x^2}{4\delta} + \frac{(1-\delta)(1-(2x-1)\delta)}{8\delta^3}\left[-1 - \ln\frac{(1+\delta)}{(1-(2x-1)\delta)} + \frac{(1+\delta)}{(1-(2x-1)\delta)}\right]\right\} \tag{12}$$

where $C_0$ in Equation 12 above is the same constant $C_0$ found in Equations 7–9 for the rectangular thermo-mechanical bending portion case. The quantity δ expresses the amount of taper in units of $w_0$. Further, Equation 12 above reduces to Equation 7 for the rectangular case as $\delta \to 0$.

The beneficial effects of a taper-shaped thermo-mechanical bending portion may be further understood by examining the amount of load P induced deflection at the free end location 18 and normalizing by the amount of deflection, $-C_0/3$, that was found for the rectangular shape case (see Equation 9). The normalized deflection at the free end is designated $\bar{y}(1)$:

$$\bar{y}(1) = \frac{3}{4}\left[\frac{2\delta-1}{\delta^2} + \frac{(1-\delta)^2}{2\delta^3}\ln\frac{(1+\delta)}{(1-\delta)}\right]. \tag{13}$$

Figure 14:
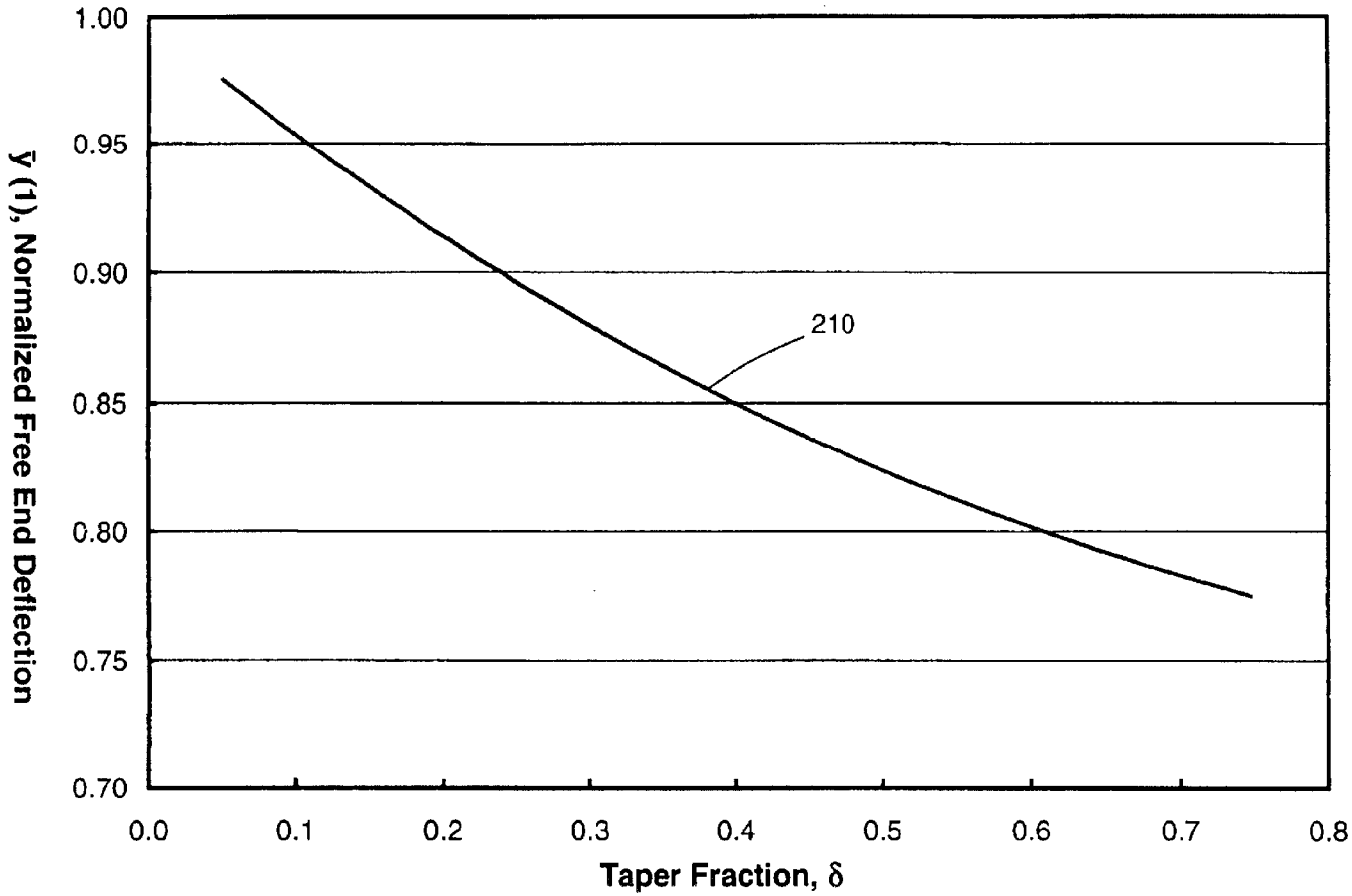
FIG. 14 is a plot of thermo-mechanical bending portion free end deflection under an imposed load for tapered thermo-mechanical actuators as a function of taper angle.

The normalized free end deflection, $\bar{y}(1)$, is plotted as a function of δ in FIG. 14, curve 210. Curve 210 in FIG. 14 shows that as δ increases the thermo-mechanical bending portion deflects less under the applied load P. For practical implementations, δ cannot be increased much beyond δ=0.75 because the implied narrowing of the free end also leads to a weak free end location 18 in the cantilevered element 20 where the thermo-mechanical bending portion 63 joins to the free end portion 27.

The normalized free end deflection plot 210 in FIG. 14 shows that a tapered or trapezoidal shaped thermo-mechanical bending portion will resist more efficiently an actuator load, or backpressure in the case of a fluid moving device. For example, if a typical rectangular thermal actuator of width $w_0$=20 μm and length L=100 μm is narrowed at the free end to $w_f$=10 μm, and broadened at the base end to $w_b$=30 μm, then δ=0.5. Such a tapered thermo-mechanical bending portion will be deflected ~18% less than the 20 μm wide rectangular thermal actuator which has the same area. This improved load resistance of the tapered thermo-mechanical bending portion is translated into an increase in actuation force and net free end deflection when pulsed with the same heat energy. Alternatively, the improved force efficiency of the tapered shape may be used to provide the same amount of force while using a lower energy heat pulse.

As illustrated in FIG. 12*b*, many shapes for the thermo-mechanical bending portion which monotonically reduce in width from base end to free end will show improved resistance to an actuation load or backpressure as compared to a rectangular bender of comparable area and length. This can be seen from Equation 4 by recognizing that the rate of change in the bending of the beam, $d^2y/dx^2$ is caused to decrease as the width is increased at the base end. That is, from Equation 4:

$$\frac{d^2y}{dx^2} \propto \frac{(1-x)}{w(x)}. \tag{14}$$

As compared to the rectangular case wherein $w(x)=w_0$, a constant, a normalized, monotonically decreasing w(x) will result in a smaller negative value for the rate of change in the slope of the beam at the base end, which is being deflected downward under the applied load P. Therefore, the accumulated amount of beam deflection at the free end, x=1, may be less. A beneficial improvement in the thermo-mechanical bending portion resistance to a load will be present if the base end width is substantially greater than the free end width, provided the free end has not been narrowed to the point of creating a mechanically weak elongated structure. The term substantially greater is used herein to mean at least 20% greater.

It is useful to the understanding of the present inventions to characterize thermo-mechanical bender portions that have a monotonically reducing width by calculating the normalized deflection at the free end, $\bar{y}(1)$ subject to an applied load P, as was done above for the linear taper shape. The normalized deflection at the free end, $\bar{y}(1)$, is calculated for an arbitrary shape 62, such as that illustrated in FIG. 12*b*, by first normalizing the shape parameters so that the deflection may be compared in consistent fashion to a similiarly constructed rectangular thermo-mechanical bending portion of length L and constant width $w_0$. The length of and the distance along the arbitrary shaped thermo-mechanical bender portion 62, x, are normalized to L so that x ranges from x=0 at the anchor location 14 to x=1 at the free end location 18.

The width reduction function, w(x), is normalized by requiring that the average width of the arbitrary shaped thermo-mechanical bender portion 62 is $w_0$. That is, the normalized width reduction function, $\bar{w}(x)$, is formed by adjusting the shape parameters so that $$\int_0^1 \frac{\bar{w}(x)}{w_0} dx = 1. \tag{15}$$

The normalized deflection at the free end, $\bar{y}(1)$, is then calculated by first inserting the normalized width reduction function, $\bar{w}(x)$, into differential Equation 4:

$$\frac{d^2 y}{dx^2} = \frac{12PL^3}{Eh^3 w_0} \frac{(x-1)}{\bar{w}(x)} = C_0 \frac{(x-1)}{\bar{w}(x)}, \tag{16}$$

where $C_0$ is the same coefficient as given in above Equation 8.

Equation 16 is integrated twice to determine the deflection, y(x), along the thermo-mechanical bender portion 62. The integration solutions are subjected to the boundary conditions noted above, y(0)=dy(0)/dx=0. In addition, if the normalized width reduction function $\bar{w}(x)$ has steps, i.e. discontinuities, y and dy/dx are required to be continuous at the discontinuities. y(x) is evaluated at free end location 18, x=1, and normalized by the quantity $(-C_0/3)$, the free end deflection of a rectangular thermo-mechanical bender of length L and width $w_0$. The resulting quantity is the normalized deflection at the free end, $\bar{y}(1)$:

$$\bar{y}(1) = -3\int_0^1 \left[\int_0^{x_2} \frac{(x_1-1)}{\bar{w}(x_1)} dx_1\right] dx_2. \tag{17}$$

If the normalized deflection at the free end, $\bar{y}(1)<1$, then that thermo-mechanical bender portion shape will be more resistant to deflection under load than a rectangular shape having the same area. Such a shape may be used to create a thermal actuator having more deflection for the same input of thermal energy or the same deflection with the input of less thermal energy than the comparable rectangular thermal actuator. If, however, $\bar{y}(1)>1$, then the shape is less resistant to an applied load or backpressure effects and is disadvantaged relative to a rectangular shape.

The normalized deflection at the free end, $\bar{y}(1)$, is used herein to characterize and evaluate the contribution of the shape of the thermo-mechanical bender portion to the performance of a cantilevered thermal actuator. $\bar{y}(1)$ may be determined for an arbitary width reduction shape, w(x), by using well known numerical integration methods to calculate $\bar{w}(x)$ and evaluate Equation 17. All shapes which have $\bar{y}(1)<1$ are preferred embodiments of the present inventions.

Figure 15:
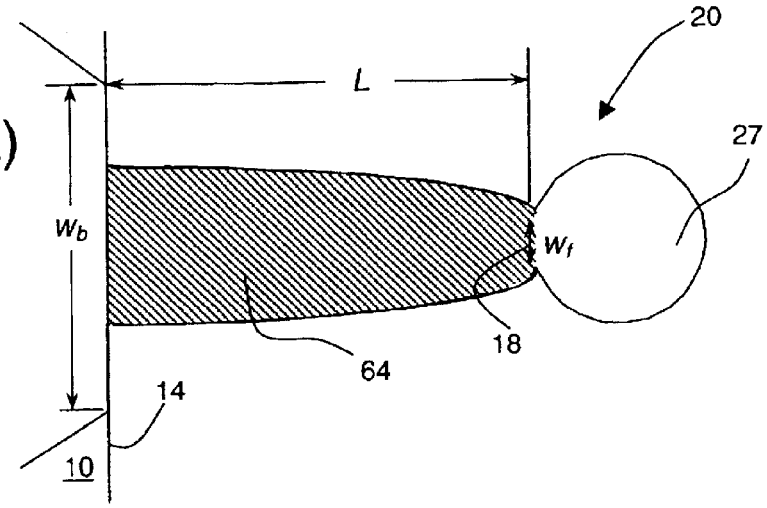
FIGS. 15(*a*)–15(*c*) are plan views of alternative designs for a thermo-mechanical bending portion according to the present inventions.
Figure 15:
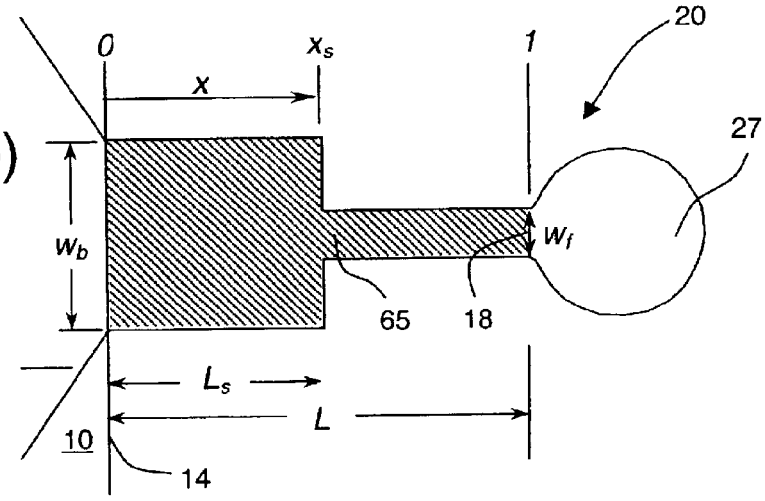
Figure 15:
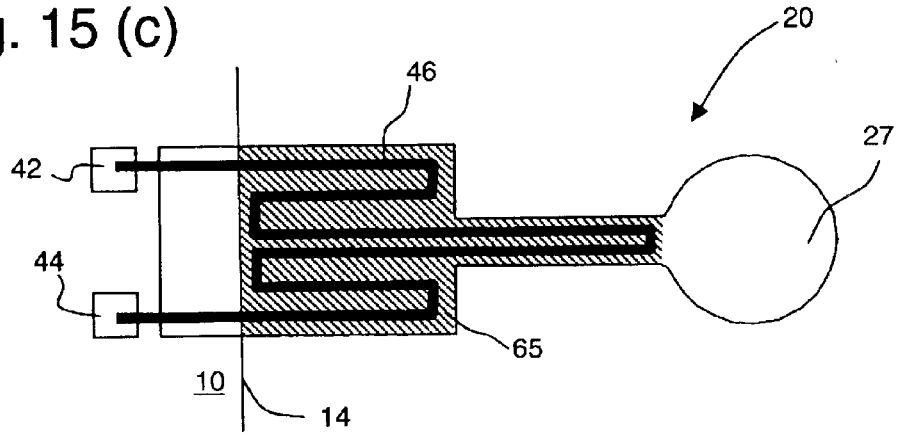

Two alternative shapes which embody the present inventions are illustrated in FIG. 15. FIG. 15*a* illustrates a thermo-mechanical bending portion 64 having a supralinear width reduction, in this case a quadratic change in the width from $w_b$ to $w_f$:

$$w(x) = \left(\frac{w_f - w_b}{L^2}\right)x^2 + w_b,\ 0 \le x \le L. \tag{18}$$

FIG. 15*b* illustrates a stepwise reducing thermo-mechanical bending portion 65 which has a single step reduction at $x=x_s$:

$$\begin{aligned} w(x) &= w_b,\ 0 \le x \le x_s \\ &= w_f,\ x_s \le x \le 1.0. \end{aligned} \tag{19}$$

A supralinear width function similar to Equation 18 will be analyzed in closed form hereinbelow. The stepwise shape, Equation 19, is more readily amenable to a closed form solution which further aids in understanding the present inventions.

FIG. 15*c* illustrates an alternate apparatus adapted to apply a heat pulse directly to the thermo-mechanical bending portion 65, thin film resistor 46. A thin film resistor may be formed on substrate 10 before construction of the cantilevered element 20 and thermo-mechanical bending portion 65, applied after completion, or at an intermediate stage. Such heat pulse application apparatus may be used with any of the thermo-mechanical bending portion designs of the present inventions.

A first stepwise reducing thermo-mechanical bending portion 65 that may be examined is one that reduces at the midway point, $x_s=0.5$ in units of L. That is, $$\begin{aligned} w(x) &= w_0(1+\delta),\ 0 \le x \le 0.5 \\ &= w_0(1-\delta),\ 0.5 \le x \le 1.0. \end{aligned} \tag{20}$$

where $\delta=(w_b-w_f)/2w_0$ and the area of the thermo-mechanical bending portion 65 is equal to a rectangular bender of width $w_0$ and length L. Equation 4 may be solved for the deflection y(x) experienced under a load P applied at the free end location 18 of stepped thermo-mechanical bending portion 65. The boundary conditions y(0)=dy(0)/dx=0 are supplemented by requiring continuity in y and dy/dx at the step $x_s=0.5$. The deflection, y(x), under load P, is found to be:

$$y_1(x) = \frac{C_0}{(1+\delta)}\left[\frac{x^3}{6} - \frac{x^2}{2}\right], 0 \le x \le \frac{1}{2} \tag{21}$$

$$y_2(x) = \frac{C_0}{(1-\delta)}\left[\frac{x^3}{6} - \frac{x^2}{2} + \frac{3}{4}\frac{\delta}{(1+\delta)}x - \frac{1}{6}\frac{\delta}{(1+\delta)}\right], \frac{1}{2} \le x \le 1$$

The deflection of the stepped thermo-mechanical bending portion at the free end location 18, normalized by the free end deflection of the rectangular bender of equal area and length is:

$$\bar{y}_2(1) = \frac{1}{(1-\delta)}\left[1 - \frac{7}{4}\frac{\delta}{(1+\delta)}\right]. \tag{22}$$

Figure 16:
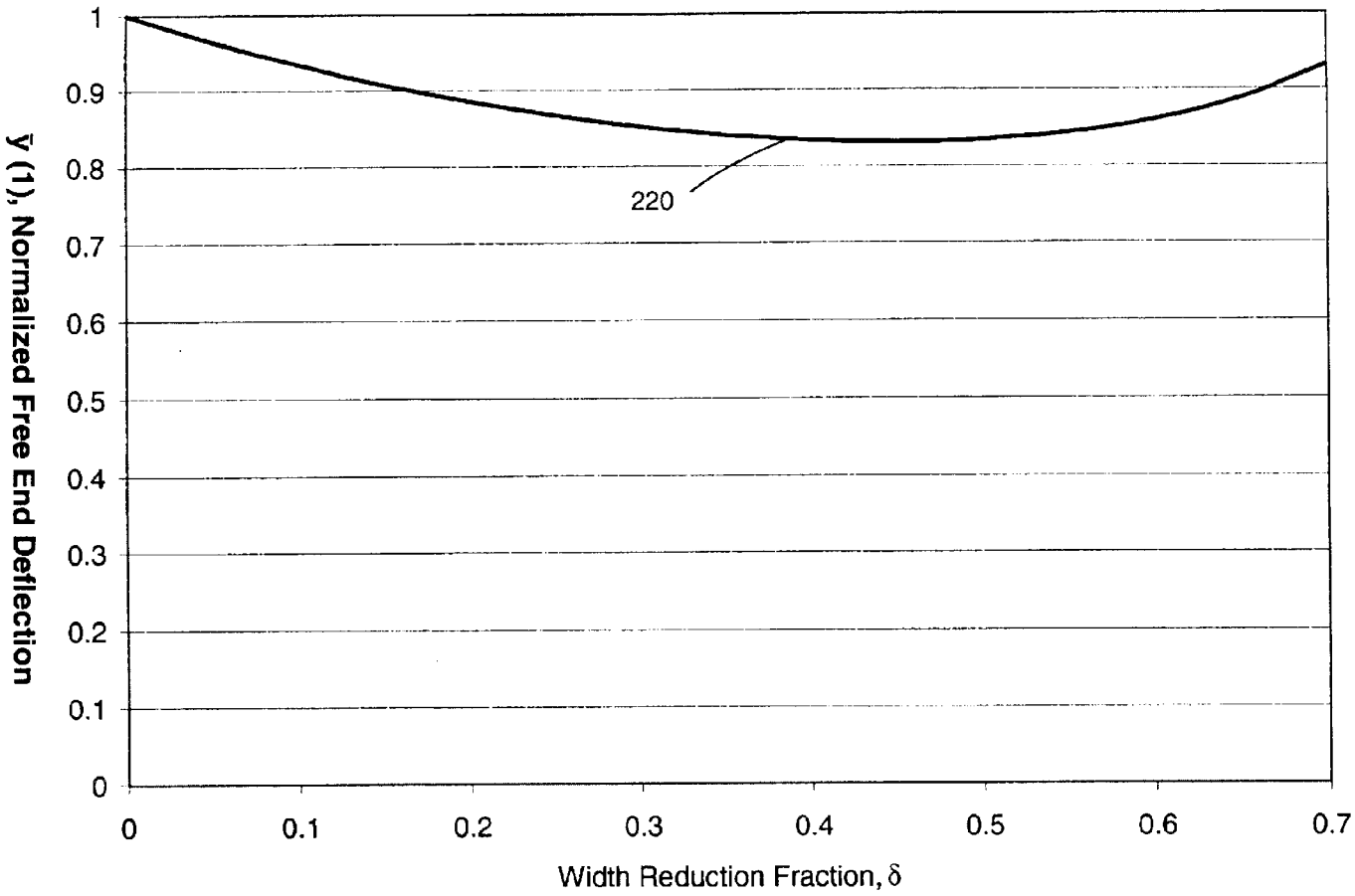
FIG. 16 is a plot of thermo-mechanical bending portion free end deflection under an imposed load for stepped reduction thermo-mechanical actuators as a function of width reduction.

Equation 22 is plotted as plot 220 in FIG. 16 as a function of δ. It can be seen that the stepped thermo-mechanical bending portion 65 shows an improved resistance to the load P for fractions up to about δ~0.5 at which point the beam becomes weak and the resistance declines. By choosing a step reduction of ~0.5 $w_0$, the stepped beam will deflect ~16% less than a rectangular thermo-mechanical bending portion of equal area and length. This increased load resistance is comparable to that found for a trapezoidal shaped thermo-mechanical bending portion having a taper fraction of δ=0.5 (see plot 210, FIG. 14).

FIG. 16 indicates that there is an optimum width reduction for a given step position for stepped thermo-mechanical bending portions. It is also the case that there may be an optimum step position, $x_s$, for a given fractional width reduction of the stepped thermo-mechanical bending portion. The following general, one-step width reduction case is analyzed:

$$w(x) = w_b = w_0(1 - f + fx_s)/x_s,\ 0 \le x \le x_s \tag{23}$$
$$= w_f = w_0 f,\ x_s \le x \le 1.0.$$

where $f$ is the fraction of the free end width compared to the nominal width $w_0$ for a rectangular thermo-mechanical bending portion, $f=w_f/w_0$. Equation 23 is substituted into differential Equation 4 using the boundary conditions as before, y(0)=dy(0)/dx=0 and continuity in y and dy/dx at step $x_s$. The normalized deflection at the free end location 18 is found to be:

$$\bar{y}(1) = \frac{1}{f}\left[1 + \frac{(f-1)(x_s^3 - 3x_s^2 + 3x_s)}{(1 - f + fx_s)}\right]. \tag{24}$$

The slope of Equation 24 as a function of $x_s$ is examined to determine the optimum values of $x_s$ for a choice of $f$:

$$\frac{d\bar{y}(1)}{dx_s} = \frac{(f-1)}{f}\left\{\frac{(1 - f + fx_s)(3x_s^2 - 6x_s + 3) - f(x_s^3 - 3x_s^2 + 3x_s)}{(1 - f + fx_s)^2}\right\}. \tag{25}$$

The slope function in Equation 25 will be zero when the numerator in the curly brackets is zero. The values of $f$ and $x_s$ which result in the minimum value of the normalized deflection of the free end, $f^{opt}$ and $x_s^{opt}$, are found from Equation 25 to obey the following relationship:

$$f^{opt} = \frac{-3(x_s^{opt} - 1)^2}{2(x_s^{opt} - 1)^3 - 1}. \tag{26}$$

Figure 17:
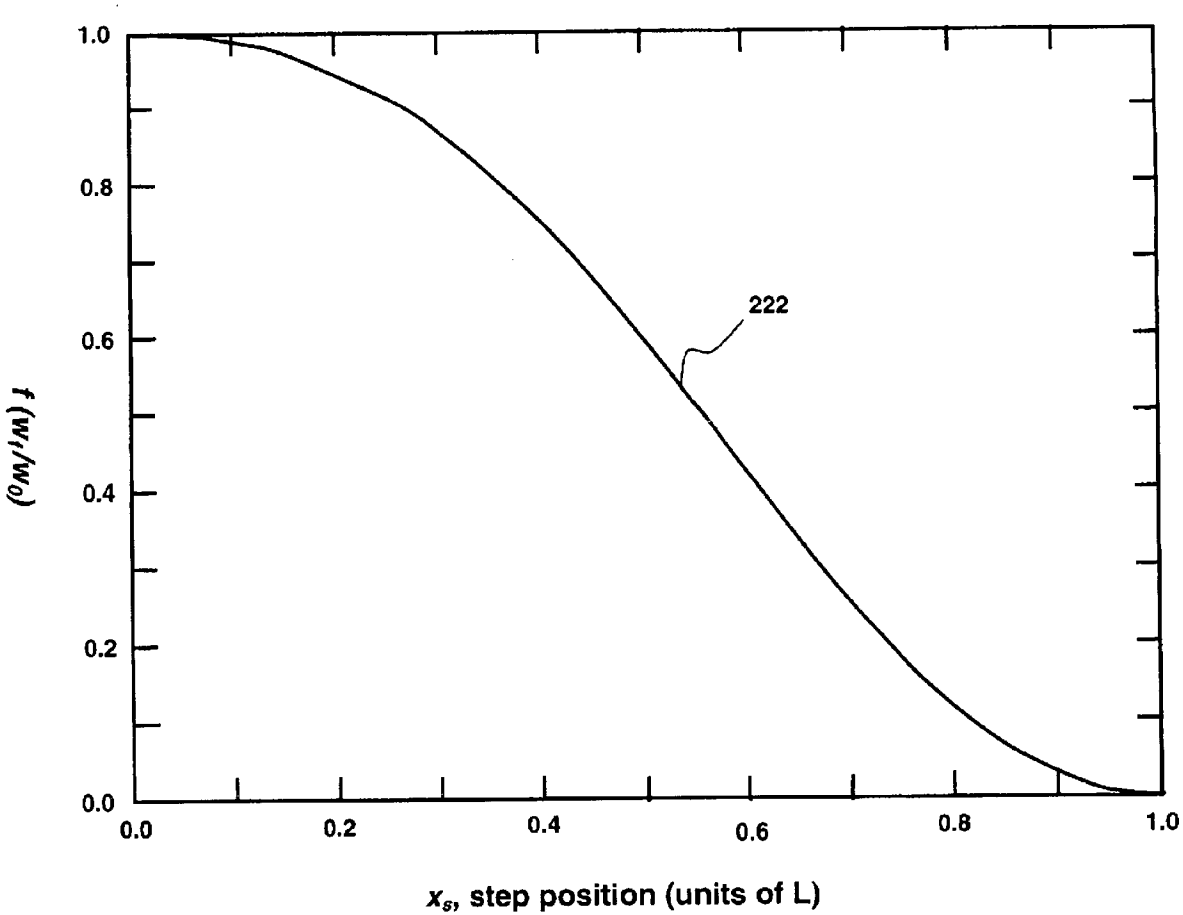
FIG. 17 is a plot of the parameters of a single step reduction shaped thermo-mechanical bender portion that yield the minimum normalized deflection of the free end.

The relationship between $f^{opt}$ and $x_s^{opt}$ given in Equation 26 is plotted as curve 222 in FIG. 17.

The minimum value for the normalized deflection of the free end, $\bar{y}_{min}(1)$, that can be realized for a given choice of the location of the step position, may be calculated by inserting the value of $f^{opt}$ into Equation 4 above. This yields an expression for the minimum value of the normalized deflection of the free end of a single step reduction thermo-mechanical bender portion that may be achieved:

$$\bar{y}_{\min}(1) = \frac{4(x_s^{opt} - 1)^7 + 6(x_s^{opt} - 1)^6 + 2(x_s^{opt} - 1)^4 + 3(x_s^{opt} - 1)^3 - 2x - 1}{-3\left((x_s^{opt} - 1)^3 + 1\right)}. \tag{27}$$

Figure 18:
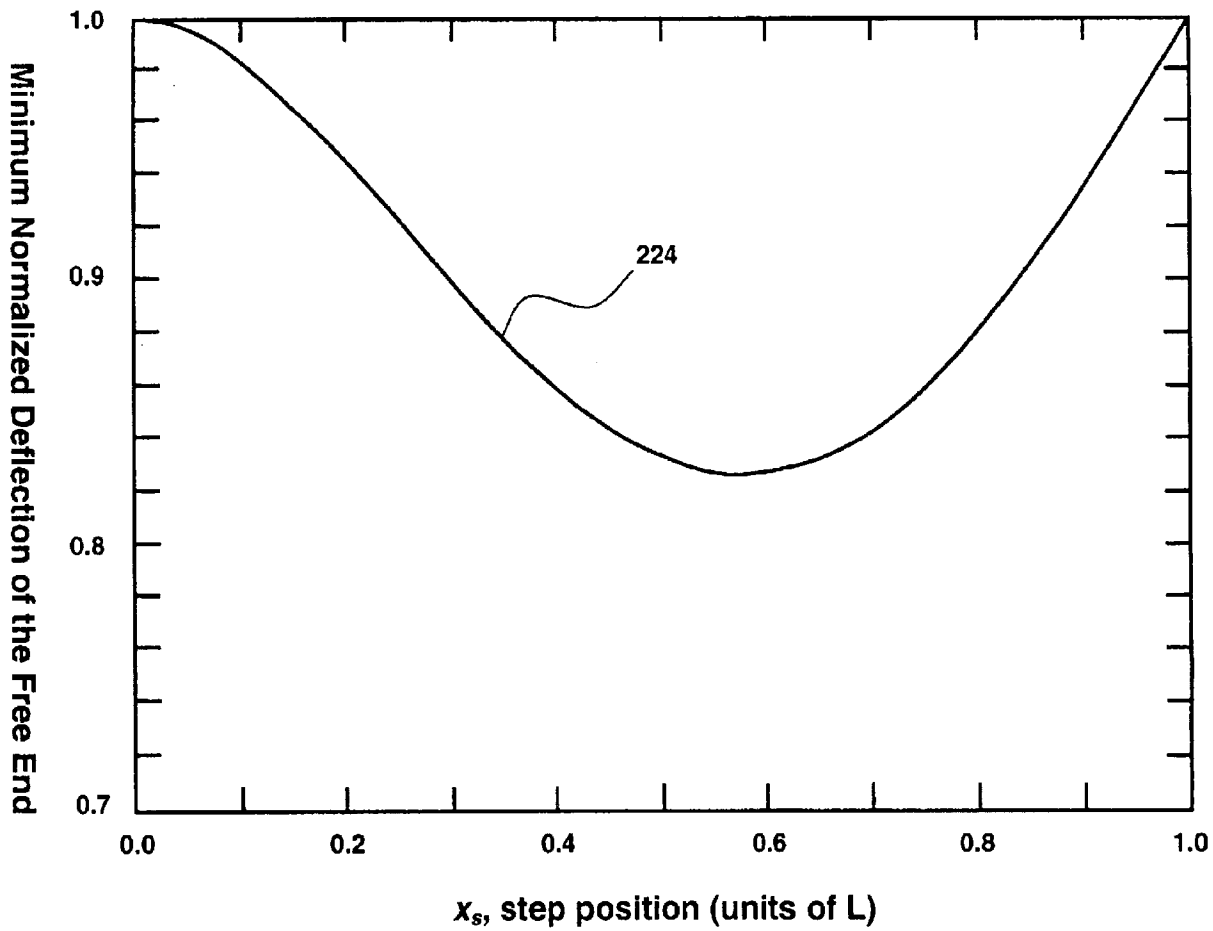
FIG. 18 is a plot of the minimum normalized deflection of the free end of a single step reduction thermo-mechanical bender portion resulting from the optimum parameters plotted in FIG. 17, as a function of the step position.

The minimum value for the normalized deflection of the free end, $\bar{y}_{min}(1)$, is plotted as a function of the location of the step position, $x_s$, is plotted as curve 224 in FIG. 18. It may be seen from FIG. 18 that to gain at least a 10% improvement in load resistance, over a standard rectangular shape for the thermo-mechanical bender portion, the step position may be selected in the range is $x_s$~0.3 to 0.84. Selection of $x_s$ in this range, coupled with selecting $f^{opt}$ according to Equation 26, allows reduction of the normalized deflection of the free end to be below 0.9, i.e., $\bar{y}(1)<0.9$.

Figure 19:
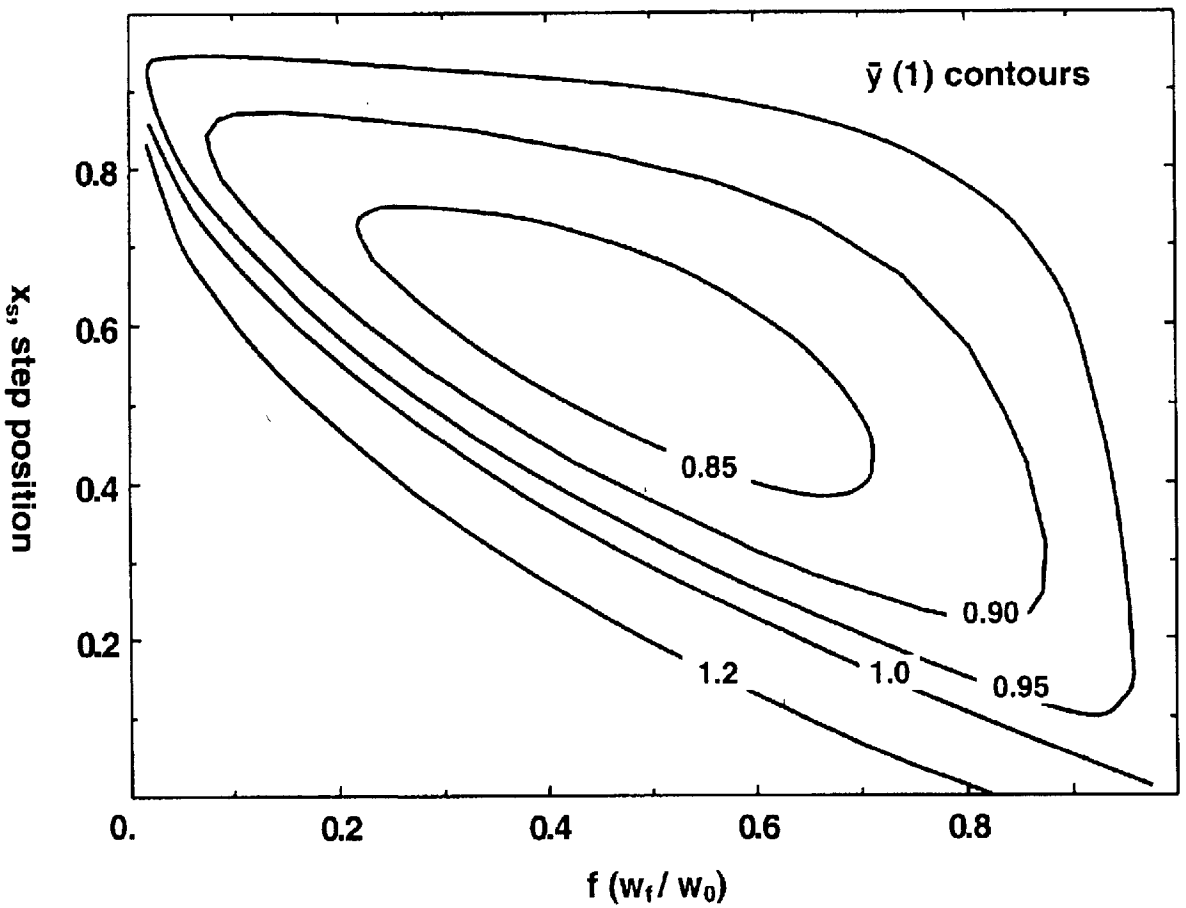
FIG. 19 shows contour plots of the thermo-mechanical bending portion free end deflection under an imposed load for single step reduction thermo-mechanical actuators as a function of step position and free end width reduction.

The normalized deflection, $\bar{y}(1)$, at the free end location 18 expressed in Equation 24 is contour-plotted in FIG. 19 as a function of the free end width fraction, $f$, and the step position $x_s$. The contours in FIG. 19 are lines of constant $\bar{y}(1)$, ranging from $\bar{y}(1)=1.2$ to $\bar{y}(1)=0.85$, as labeled. Beneficial single step width reduction shapes are those that have $\bar{y}(1)<1.0$. There are not choices for the parameters $f$ and $x_s$ that result in values of $\bar{y}(1)$ much less than the $\bar{y}(1)=0.85$ contour in FIG. 19, as may also be understood from FIG. 18. Those stepped width reduction shapes wherein $\bar{y}(1) \geqq 1.0$ are not preferred embodiments of the present inventions. These shapes are conveyed by parameter choices in the lower left corner of the plot in FIG. 19.

It may be understood from the contour plots of FIG. 19 that there are multiple combinations of the two variables, $f$ and $x_s$, which produce some beneficial reduction in the deflection of the free end under load. For example, the $\bar{y}(1)=0.85$ contour in FIG. 19 illustrates that a mechanical bending portion could be constructed having a free end width fraction of $f=0.5$ with a step position of either $x_s=0.45$ or $x_s=0.68$.

Figure 20A:
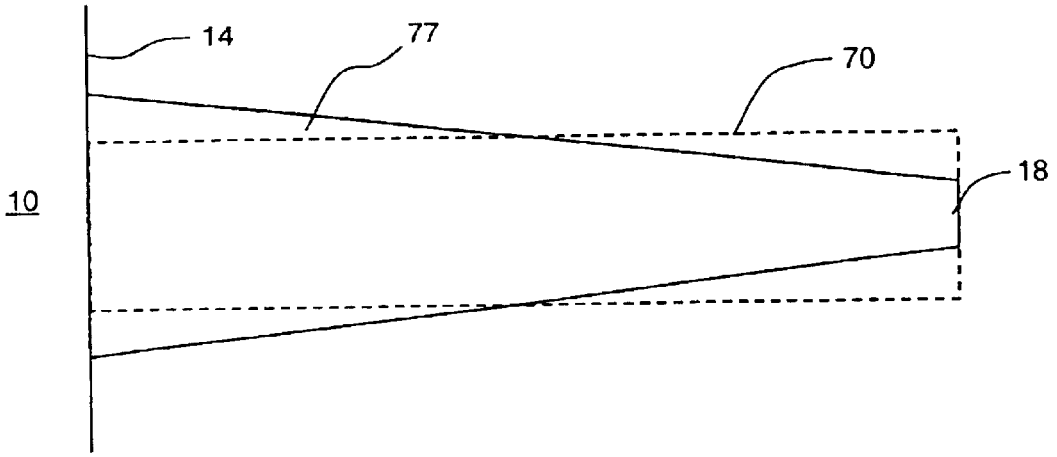
FIGS. 20(*a*) and 20(*b*) are plan views of alternative designs for a thermo-mechanical bending portion according to the present inventions.
Figure 20B:
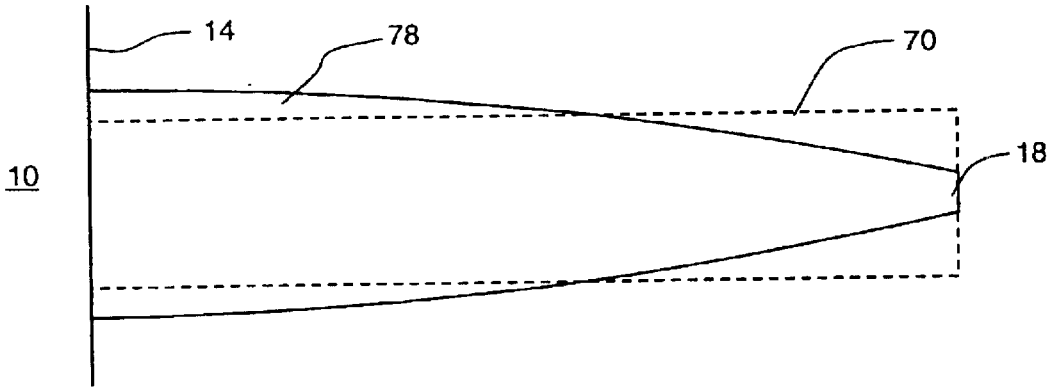

A supralinear width reduction functional form which is amenable to closed form solution is illustrated in FIGS. 20*a* and 20*b*. Thermo-mechanical bending portion 77 in FIG. 20*a* and thermo-mechanical bending portion 78 in FIG. 20*b* have width reduction functions that have the following quadratic form:

$$w(x)=2w_0[a-b(x+c)^2]=w_0\bar{w}(x) \tag{28}$$

where imposing the shape normalization requirement of Equation 15 above results in the relation for the parameter "a" as a function of b and c:

$$a = \frac{1}{2}\left[1 + \frac{2b}{3}(1 + 3c + 3c^2)\right]. \tag{29}$$

Further, in order that the free end of the thermo-mechanical bending portion is greater than zero, c must satisfy:

$$c < \frac{1}{2}\left[\frac{1}{b} - \frac{4}{3}\right]. \tag{30}$$

Phantom rectangular shape 70 in FIGS. 20*a* and 20*b* illustrates a rectangular thermo-mechanical bender portion having the same length L and average width $w_0$ as the quadratic shapes 77 and 78.

The potentially beneficial effects of quadratic shaped thermo-mechanical bender portions 77 and 78, illustrated in FIGS. 20*a* and 20*b*, may be understood by calculating the normalized deflection of the free end, $\bar{y}(1)$, using Equation 17 and the boundary conditions above noted. Inserting the expression for $\bar{w}(x)$ given in Equation 28 into Equation 17 yields:

$$\bar{y}(1) = \frac{3}{4b}\left\{\sqrt{\frac{b}{a}}\left(\frac{a}{b} + (1+c)^2\right)\ln\left[\frac{\left(\sqrt{\frac{a}{b}} + 1 + c\right)\left(\sqrt{\frac{a}{b}} - c\right)}{\left(\sqrt{\frac{a}{b}} - 1 - c\right)\left(\sqrt{\frac{a}{b}} + c\right)}\right]\right\} + \frac{3}{4b}\left\{2(1+c)\ln\left[\frac{\frac{a}{b} - (1+c)^2}{\frac{a}{b} - c^2}\right] - 2\right\}, \tag{31}$$

where a is related to b and c as specified by Equation 29 and c is limited as specified by Equation 30.

Figure 21:
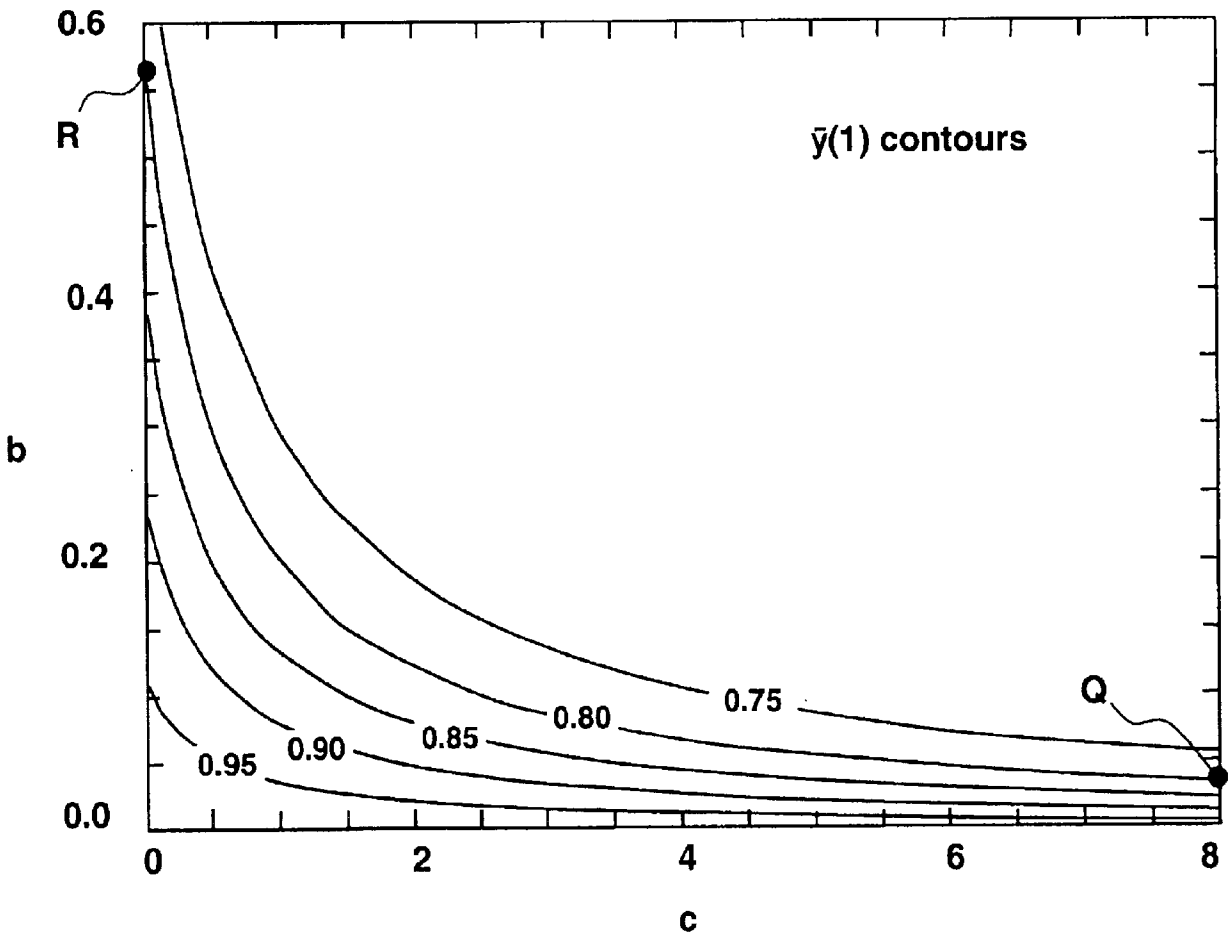
FIG. 21 shows contour plots of the thermo-mechanical bending portion free end deflection under an imposed load for width reduction shapes of the form illustrated in FIG. 20.

The normalized deflection, $\bar{y}(1)$, at the free end location 18 expressed in Equation 31 is contour-plotted in FIG. 21 as a function of the parameters b and c. The contours in FIG. 21 are lines of constant $\bar{y}(1)$, ranging from $\bar{y}(1)=0.95$ to $y(1)=0.75$, as labeled. Beneficial quadratic width reduction shapes are those that have $\bar{y}(1)<1.0$. There are not choices for the parameters b and c that result in values of $\bar{y}(1)$ much less than the $\bar{y}(1)=0.75$ contour in FIG. 21. It may be understood from the contour plots of FIG. 21, or from Equation 31 directly, that the quadratic width reduction functional form Equation 28 does not yield shapes having $\bar{y}(1)>1.0$. The parameter space bounded by Equation 30 does not result in some shapes having long, narrow weak free end regions as may be the case for the single step width reduction shapes discussed above or the inverse-power shapes to be discussed hereinbelow.

It may be understood from the contour plots of FIG. 21 that there are many combinations of the two parameters, b and c, which produce some beneficial reduction in the deflection of the free end under load. For example, the $\bar{y}(1)=0.80$ contour in FIG. 21 illustrates that a beneficial thermo-mechanical bending portion could be constructed having a shape defined by Equation 28 wherein b=0.035 and c=8.0, point Q, or wherein b=0.57 and c=0.0, point R. These two shapes are those illustrated in FIGS. 20*a* and 20*b*. That is, thermo-mechanical bender portion 77 illustrated in FIG. 20*a* was formed according to Equation 28 wherein a=3.032, b=0.035, and c=8.0, i.e. point Q in FIG. 21. Thermo-mechanical bender portion 78 illustrated in FIG. 20*b* was formed according to Equation 28 wherein a=0.69, b=0.57 and c=0.0, i.e. point R in FIG. 21.

Figure 22:
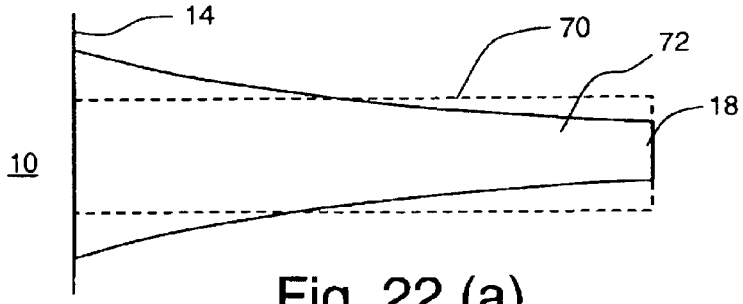
FIGS. 22(*a*)–22(*c*) are plan views of alternative designs for a thermo-mechanical bending portion.
Figure 22:
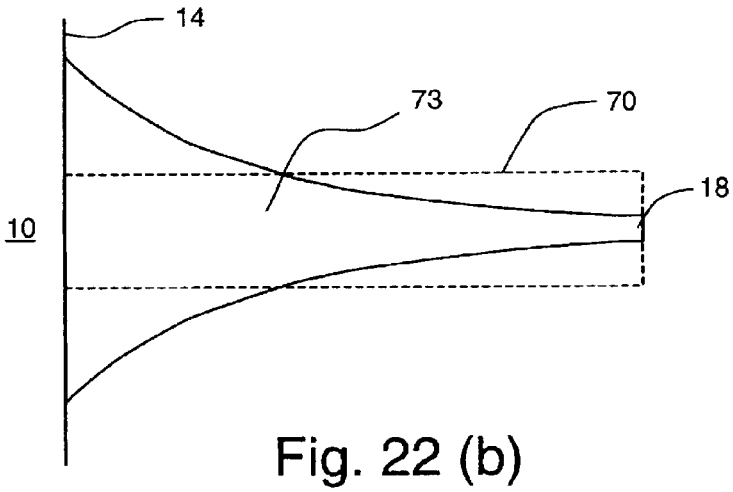
Figure 22:
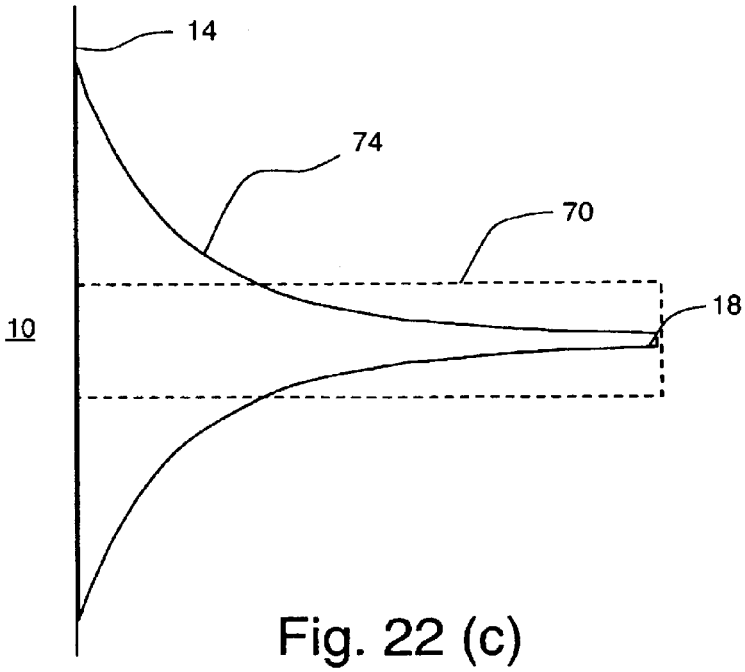

Another width reduction functional form, an inverse-power function, which is amenable to closed form solution is illustrated in FIGS. 22*a*–22*c*. Thermo-mechanical bending portions 72, 73, and 74 in FIGS. 22*a*–22*c*, respectively, have width reduction functions that have the following inverse-power form:

$$w(x) = 2w_0\left[\frac{a}{(x+b)^n}\right] = w_0\bar{w}(x), \tag{32}$$

where $n \geqq 0$, $b>0$. Imposing the shape normalization requirement of Equation 15 above results in the relation for the parameter "a" as a function of b and n:

$$2a = \frac{n-1}{b^{1-n} - (1+b)^{1-n}},\ n \neq 1, \qquad 2a = \frac{1}{\ln\left(\frac{1+b}{b}\right)},\ n = 1. \tag{33}$$

Phantom rectangular shape 70 in FIGS. 22*a*–22*c* illustrates a rectangular thermo-mechanical bender portion having the same length L and average width $w_0$ as the inverse-power shapes 72, 73 and 74.

The potentially beneficial effects of inverse-power shaped thermo-mechanical bender portions, illustrated in FIGS. 22*a*–22*c*, may be understood by calculating the normalized deflection of the free end, $\bar{y}(1)$, using Equation 17 and the boundary conditions above noted. Inserting the expression for $\bar{w}(x)$ given in Equation 32 into Equation 17 yields:

$$\bar{y}(1) = 3\left[\frac{b^{1-n} - (1+b)^{1-n}}{n-1}\right] \times \left\{\left(\frac{(1+b)^{n+3} - 2b^{n+2} - (n+2)b^{n+1} - b^{n+3}}{(n+1)(n+2)}\right) - \left(\frac{(1+b)^{n+3} - b^{n+3}}{(n+2)(n+3)}\right)\right\}, \tag{34}$$

where a is related to b and n as specified by Equation 33.

Figure 23:
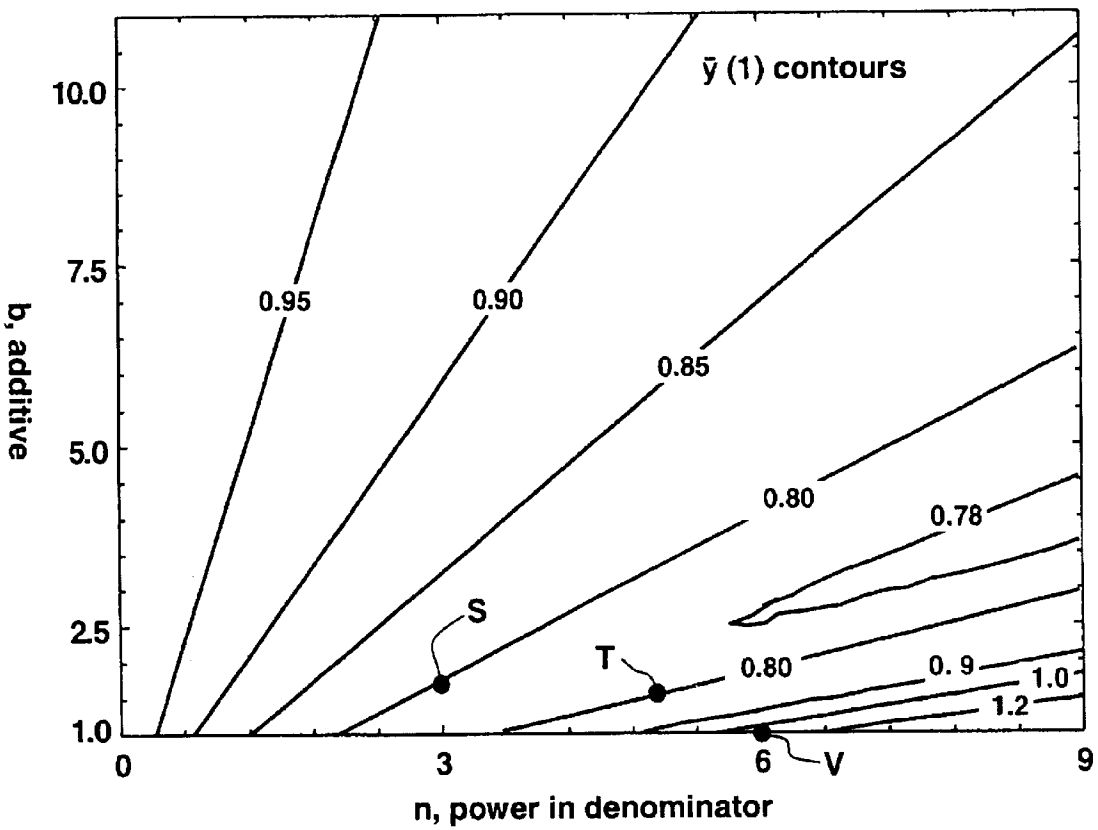
FIG. 23 shows contour plots of the thermo-mechanical bending portion free end deflection under an imposed load for width reduction shapes of the form illustrated in FIG. 22.

The normalized deflection at the free end location 18, $\bar{y}(1)$ expressed in Equation 34, is contour-plotted in FIG. 23 as a function of the parameters b and n. The contours in FIG. 23 are lines of constant $\bar{y}(1)$, ranging from $\bar{y}(1)=0.78$ to $\bar{y}(1)=1.2$, as labeled. There are not choices for the parameters b and n that result in values of $\bar{y}(1)$ much less than the $\bar{y}(1)=0.78$ contour in FIG. 23. Beneficial inverse-power width reduction shapes are those that have $\bar{y}(1)<1.0$.

It may be understood from the contour plots of FIG. 23 that there are many combinations of the two parameters, b and n which produce some beneficial reduction in the deflection of the free end under load. For example, the $\bar{y}(1)=0.80$ contour in FIG. 23 illustrates that a beneficial thermo-mechanical bending portion could be constructed having a shape defined by Equation 32 wherein b=1.75 and n=3, point S, or wherein b=1.5 and n=5, point T. These two shapes are those illustrated in FIGS. 22*a* and 22*b*. That is, thermo-mechanical bender portion 72 illustrated in FIG. 22*a* was formed according to Equation 32 wherein 2a=10.03, b=1.75, and n=3, i.e. point S in FIG. 23. Thermo-mechanical bender portion 73 illustrated in FIG. 22*b* was formed according to Equation 32 wherein 2a=23.25, b=1.5 and n=5 i.e. point T in FIG. 23.

The inverse-power shaped thermo-mechanical bender portion 74 illustrated in FIG. 22*c* does not provide a beneficial resistance to an applied load or backpressure as compared to a rectangular shape having the same area. Thermo-mechanical bender portion 74 is constructed according to Equation 32 wherein 2a=5.16, b=1, n=6, point V in FIG. 23. This shape has a normalized deflection at the free end value of $\bar{y}(1)=1.1$. Examination of the various width reduction functional forms discussed herein indicates that the thermo-mechanical bender portion shape will be less efficient than a comparable rectangular shape if the free end region is made too long and narrow. Even though the widened base end width of such shapes improves the resistance to an applied load P, the long, narrow free end is so weak that its deflection negates the benefit of the stiffer base region. Inverse-power width reduction shapes having $\bar{y}(1)\geqq 21.0$ are not preferred embodiments of the present inventions.

Several mathematical forms have been analyzed herein to assess thermomechanical bending portions having monotonically reducing widths from a base end of width $w_b$ to a free end of width $w_f$, wherein $w_b$ is substantially greater than $w_f$. Many other shapes may be constructed as combinations of the specific shapes analyzed herein. Also, shapes that are only slightly modified from the precise mathematical forms analyzed will have substantially the same performance characteristics in terms of resistant to an applied load. All shapes for the thermo-mechanical bender portion which have normalized deflections of the free end values, $\bar{y}(1)<1.0$, are anticipated as preferred embodiments of the present inventions.

The load force or back pressure resistance reduction which accompanies narrowing the free end of the thermo-mechanical bending portion necessarily means that the base end is widened, for a constant area and length. The wider base has the additional advantage of providing a wider heat transfer pathway for removing the activation heat from the cantilevered element. However, at some point a wider base end may result in a less efficient thermal actuator if too much heat is lost before the actuator reaches an intended operating temperature.

Figure 24:
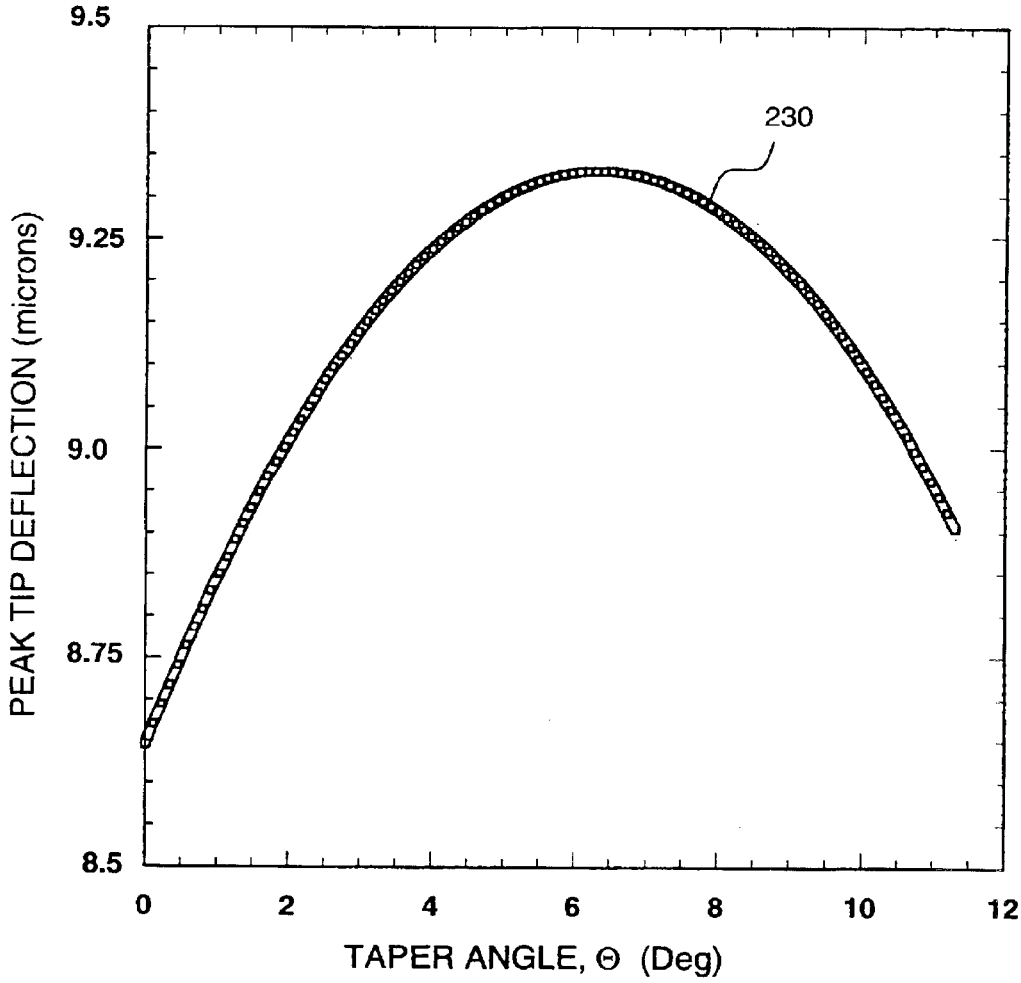
FIG. 24 plots a numerical simulation of the peak deflection of a tapered thermo-mechanical actuator, when actuated, as a function of taper angle.

Numerical simulations of the activation of trapezoidal shaped thermo-mechanical bending portions, as illustrated in FIG. 13, have been carried out using device dimensions and heat pulses representative of a liquid drop emitter application. The calculations assumed uniform heating over the area of the thermo-mechanical bending portion 63. The simulated deflection of the free end location 18 achieved, against a representative fluid backpressure, is plotted as curve 230 in FIG. 24 for tapered thermo-mechanical bending portions having taper angles $\Theta\sim 0^0$ to $11^0$. The energy per pulse input was held constant as were the lengths and overall areas of the thermo-mechanical bending portions having different taper angles. For the plot in FIG. 24, the deflection is larger for a device having more resistance to the back pressure load. It may be understood from plot 230, FIG. 24, that a taper angle in the range of $3^0$ to $10^0$ offers substantially increased deflection or energy efficiency over a rectangular thermo-mechanical bending portion having the same area and length. The rectangular device performance is conveyed by the $\Theta=0^0$ value of plot 230.

The fall-off in deflection at angles above 6° in plot 230 is due to thermal losses from the widening base ends of the thermo-mechanical bending portion. The more highly tapered devices do not reach the intended operating temperature because of premature loss in activation heat. An optimum taper or width reduction design preferably is selected after testing for such heat loss effects.

While much of the foregoing description was directed to the configuration and operation of a single thermal actuator or drop emitter, it should be understood that the present invention is applicable to forming arrays and assemblies of multiple thermal actuators and drop emitter units. Also it should be understood that thermal actuator devices according to the present invention may be fabricated concurrently with other electronic components and circuits, or formed on the same substrate before or after the fabrication of electronic components and circuits.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

PARTS LIST

10 substrate base element
12 liquid chamber
13 gap between cantilevered element and chamber wall
14 cantilevered element anchor location
15 thermal actuator
16 liquid chamber curved wall portion
18 free end of the thermo-mechanical bending portion
20 cantilevered element
21 passivation layer
22 first layer
23 second layer
25 heater resistor
26 cantilevered element anchor end portion
27 cantilevered element free end portion
28 liquid chamber structure, walls and cover
29 patterned sacrificial layer
30 nozzle
41 TAB lead
42 electrical input pad
43 solder bump
44 electrical input pad
46 thin film resistor
50 drop
52 vapor bubbles
60 working liquid
62 thermo-mechanical bending portion with monotonic width reduction
63 trapezoidal shaped thermo-mechanical bending portion
64 thermo-mechanical bending portion with supralinear width reduction
65 thermo-mechanical bending portion with stepped width reduction
66 heater resistor segments
68 current coupling device
70 comparable area rectangular thermo-mechanical bender portion
72 thermo-mechanical bending portion with inverse-power width reduction
73 thermo-mechanical bending portion with inverse-power width reduction
74 thermo-mechanical bending portion with inverse-power width reduction
77 thermo-mechanical bending portion with quadratic width reduction

78 thermo-mechanical bending portion with quadratic width reduction

80 support structure

100 ink jet printhead

110 drop emitter unit

200 electrical pulse source

300 controller

400 image data source

500 receiver

What is claimed is:

1. A thermal actuator for a micro-electromechanical device comprising:

(a) a base element;

(b) a cantilevered element including a thermo-mechanical bending portion extending from the base element and a free end portion residing in a first position, the thermo-mechanical bending portion having a base end width, $w_b$, adjacent the base element and a free end width, $w_f$, adjacent the free end portion wherein the base end width is substantially greater than the free end width; and (c) apparatus adapted to apply a heat pulse directly to the thermo-mechanical bending portion causing the deflection of the free end portion of the cantilevered element to a second position, wherein the thermo-mechanical bending portion extends a length L from the base element to the free end portion, has an average width $w_0$, and has normalized free end deflection, $\bar{y}(1)$, wherein $\bar{y}(1)<1.0$.

2. The thermal actuator of claim 1 wherein the width w(x) of the thermo-mechanical bending portion reduces from the base end width to the free end width as a function of a normalized distance x measured from x=0 at the base element to x=1 at length L from the base element and wherein w(x) has substantially a functional form $w(x)=2w_0(a-b(x+c)^2)$ having $a=(1+2b(1+3c+3c^2)/3)/2$ and $c<(1/b-4/3)/2$.

3. The thermal actuator of claim 2 wherein the normalized free end deflection $\bar{y}(1)<0.85$.

4. The thermal actuator of claim 1 wherein the width w(x) of the thermo-mechanical bending portion reduces from the base end width to the free end width as a function of a normalized distance x measured from x=0 at the base element to x=1 at length L from the base element and wherein w(x) has substantially a functional form $w(x)=2w_0a/(x+b)^n$ having $2a=(n-1)/(b^{1-n}-(1+b)^{1-n})$, $n\geqq 0$ and $b>0$.

5. The thermal actuator of claim 4 wherein the normalized free end deflection $\bar{y}(1)<0.85$.

6. The thermal actuator of claim 1 wherein the width of the thermo-mechanical bending portion reduces from the base end width to the free end width in at least one reduction step and the at least one reduction step occurs at a distance $L_s$ from the base element wherein $0.3\ L\leqq L_s\leqq 0.84\ L$.

7. The thermal actuator of claim 1 wherein the apparatus adapted to apply a heat pulse comprises a thin film resistor.

8. The thermal actuator of claim 1 wherein the thermo-mechanical bending portion includes a first layer constructed of a first material having a high coefficient of thermal expansion and a second layer, attached to the first layer, constructed of a second material having a low coefficient of thermal expansion.

9. The thermal actuator of claim 8 wherein the first material is electrically resistive and the apparatus adapted to apply a heat pulse includes a resistive heater formed in the first layer.

10. The thermal actuator of claim 9 wherein the first material is titanium aluminide.

11. A liquid drop emitter comprising:

(a) a chamber, formed in a substrate, filled with a liquid and having a nozzle for emitting drops of the liquid;

(b) a thermal actuator having a cantilevered element extending a from a wall of the chamber and a free end portion residing in a first position proximate to the nozzle, the cantilevered element including a thermo-mechanical bending portion extending from the base element to the free end portion, the thermo-mechanical bending portion having a base end width, $w_b$, adjacent the base element and a free end width, $w_f$, adjacent the free end portion wherein the base end width is substantially greater than the free end width; and (c) apparatus adapted to apply a heat pulse directly to the thermo-mechanical bending portion causing a rapid deflection of the free end portion and ejection of a liquid drop, wherein the thermo-mechanical bending portion extends a length L from the wall of the chamber to the free end portion, has an average width $w_0$, and has a normalized free end deflection, $\bar{y}(1)<1.0$.

12. The liquid drop emitter of claim 11 wherein the width w(x) of the thermo-mechanical bending portion reduces from the base end width to the free end width as a function of a normalized distance x measured from x=0 at the base element to x=1 at length L from the base element and wherein w(x) has substantially a functional form $w(x)=2w_0(a-b(x+c)^2)$ having $a=(1+2b(1+3c+3c^2)/3)/2$ and $c<(1/b-4/3)/2$.

13. The liquid drop emitter of claim 12 wherein the normalized free end deflection $\bar{y}(1)<0.85$.

14. The liquid drop emitter of claim 11 wherein the width w(x) of the thermo-mechanical bending portion reduces from the base end width to the free end width as a function of a normalized distance x measured from x=0 at the base element to x=1 at length L from the base element and wherein w(x) has substantially a functional form $w(x)=2w_0a/(x+b)^n$ having $2a=(n-1)/(b^{1-n}-(1+b)^{1-n})$, $n\geqq 0$, and $b>0$.

15. The liquid drop emitter of claim 14 wherein the normalized free end deflection $\bar{y}(1)<0.85$.

16. The liquid drop emitter of claim 11 wherein the width of the thermo-mechanical bending portion reduces from the base end width to the free end width in at least one reduction step and the at least one reduction step occurs at a distance $L_s$ from the base element, wherein $0.3\ L\leqq L_s\leqq 0.84\ L$.

17. The liquid drop emitter of claim 11 wherein the apparatus adapted to apply a heat pulse comprises a thin film resistor.

18. The liquid drop emitter of claim 11 wherein the liquid drop emitter is a drop-on-demand ink jet printhead and the liquid is an ink for printing image data.

19. A liquid drop emitter comprising:

(a) a chamber, formed in a substrate, filled with a liquid and having a nozzle for emitting drops of the liquid;

(b) a thermal actuator having a cantilevered element extending a from a wall of the chamber and a free end portion residing in a first position proximate to the nozzle, the cantilevered element including a thermo-mechanical bending portion extending from the base element to the free end portion, the thermo-mechanical bending portion including a first layer constructed of an electrically resistive first material having a high coefficient of thermal expansion and a second layer, attached to the first layer, constructed of a second material having a low coefficient of thermal expansion, the thermo-mechanical bending portion having a base end width, $w_b$, wherein the width of the thermo-mechanical bending portion reduces from the base end width to the free end width in a substantially monotonic function of the distance from the base element;

(c) a heater resistor formed in the first layer;

(d) a pair of electrodes connected to the heater resistor to apply an electrical pulse to cause resistive heating of the thermo-mechanical bending portion causing a rapid deflection of the free end portion and ejection of a liquid drop, wherein the thermo-mechanical bending portion extends a length L from the wall of the chamber to the free end portion, has an average with $w_0$, and has a normalized free end deflection, $\bar{y}$, wherein $\bar{y}(1)<1.0$.

20. The liquid drop emitter of claim 19 wherein the width w(x)of the thermo-mechanical bending portion reduces from the base end width to the free end width as a function of a normalized distance x measured from x=0 at the base element to x=1 at length L from the base element and wherein w(x) has substantially a functional form $w(x)=2w_0(a-b(x+c)^2)$having $a=(1+2b(1+3c+3c^2)/3)/2$ and $c<(1/b-4/3)/2$.

21. The liquid drop emitter of claim 20 wherein the normalized free end deflection $\bar{y}(1)<0.85$.

22. The liquid drop emitter of claim 19 wherein the width w(x) of the thermo-mechanical bending portion reduces from the base end width to the free end width as a function of a normalized distance x measured from x=0 at the base element to x=1 at length L from the base element and wherein w(x) has substantially a functional form $w(x)=2w_0a/(x+b)^n$ having $2a=(n-1)/(b^{1-n}-(1+b)^{1-n})$, $n\leqq.0$, and $b>0$.

23. The liquid drop emitter of claim 22 wherein the normalized free end deflection $\bar{y}(1)<0.85$.

24. The liquid drop emitter of claim 19 wherein the width of the thermo-mechanical bending portion reduces from the base end width to the free end width in at least one reduction step and the at least one reduction step occurs at a distance $L_s$ from the base element, wherein $0.3\ L\leqq L_s\leqq 0.84\ L$.

25. The liquid drop emitter of claim 19 wherein the first material is titanium aluminide.

26. The liquid drop emitter of claim 19 wherein the liquid drop emitter is a drop-on-demand ink jet printhead and the liquid is an ink for printing image data.

* * * * *

UNITED STATES PATENT AND TRADEMARK OFFICE

CERTIFICATE OF CORRECTION

PATENT NO. : 6,820,964 B2
DATED : November 23, 2004
INVENTOR(S) : Delametter et al.

It is certified that error appears in the above-identified patent and that said Letters Patent is hereby corrected as shown below:

Column 23,
Line 15, after the word "deflection," delete "$\bar{y}$" and insert -- $\bar{y}(1)$ --.

Signed and Sealed this

Twenty-ninth Day of November, 2005

JON W. DUDAS
*Director of the United States Patent and Trademark Office*